US012313375B2

(12) United States Patent
Hovhannisyan et al.

(10) Patent No.: US 12,313,375 B2
(45) Date of Patent: May 27, 2025

(54) OPEN FRAME REVOLVER WITH CHANGEABLE DRUM

(71) Applicant: ZENK LLC, Sun Valley, CA (US)

(72) Inventors: Melik Hovhannisyan, North Hollywood, CA (US); Garegin Meliki Hovhannisyan, Glendale, CA (US)

( * ) Notice: Subject to any disclaimer, the term of this patent is extended or adjusted under 35 U.S.C. 154(b) by 0 days.

(21) Appl. No.: 18/469,529

(22) Filed: Sep. 18, 2023

(65) Prior Publication Data

US 2024/0093963 A1 Mar. 21, 2024

Related U.S. Application Data

(60) Provisional application No. 63/376,040, filed on Sep. 16, 2022.

(51) Int. Cl.
*F41C 3/14* (2006.01)

(52) U.S. Cl.
CPC ..... *F41C 3/14* (2013.01)

(58) Field of Classification Search
CPC ..... F41C 3/14; F41C 3/16
See application file for complete search history.

(56) References Cited

U.S. PATENT DOCUMENTS 339,301 A * 4/1886 Johnson et al. ..... F41A 15/02 42/67
9,664,475 B1 * 5/2017 Maggiore ..... F41B 11/54
2015/0247688 A1 * 9/2015 Zonshine ..... F41A 3/58 42/8

OTHER PUBLICATIONS

Utility U.S. Appl. No. 09/288,197, filed Apr. 8, 1999.
Grad company brochure.
Arsenal RS-1 Knife/gun (first shots) Youtube video [URL] https://www.youtube.com/watch?v=m9dx06C3xcU&ab_channel=556Channel%28HD%29. Accessed Sep. 22, 2023.
Arsenal Knife with Internal Shooting Mechanism, [URL] https://www.arsenalinc.com/usa/firearms/suppressors-aow/revolver-knife.html#product-details-tab-description. Accessed Sep. 22, 2023.

* cited by examiner

*Primary Examiner* — J. Woodrow Eldred

(74) *Attorney, Agent, or Firm* — Phil IP Law Inc.; Narek Zohrabyan; Karen Kirk Galoyan

(57) ABSTRACT

An open frame revolver may have an upper frame and lower frame pivotally connected together, an opening located in between the upper frame and the lower frame. A spring assembly may be located in the lower frame and a trigger assembly located in the lower frame, wherein the trigger assembly is connected to the spring assembly. A tension axle located in the lower frame, wherein the tension axle on one end connected to the trigger assembly and spring assembly and on the other end has a lock. A hammer axle may be located inside a drum, wherein the drum could be pivotally supported by hammer axel and hammer axle may have a lock on one end. A hammer may be located outside of the upper frame connected to the hammer axle, a safety lock located in the lower frame, while a frame lock located on the lower frame.

20 Claims, 28 Drawing Sheets

OPEN FRAME REVOLVER WITH CHANGEABLE DRUM

PRIORITY CLAIMS AND CROSS-REFERENCE TO RELATED APPLICATIONS

This application is related to and claims domestic priority benefits under 35 USC § 119(e) from U.S. Provisional Patent Application Ser. No. 63/376,040 filed on Sep. 16, 2022, the entire contents, of the aforementioned application, are expressly incorporated hereinto by reference. The entire contents of the aforementioned is hereby incorporated by reference as if fully set forth herein, under 35 U.S.C. § 120. The applicant(s) hereby rescind any disclaimer of claim scope in the parent application(s) or the prosecution history thereof and advise the USPTO that the claims in this application may be broader than any claim in the parent application(s).

BACKGROUND

The disclosure here relates to the field of firearms, in particular, to an open frame type revolver with interchangeable drums.

More than 400 years has passed since the revolver type of firearm was introduced to the public and very little changes have taken place during last 100 years. In 1836, Samuel Colt patented a revolver which led to the widespread use of the revolver in America. Early revolvers were caplocks and muzzleloaders; the user poured black powder into each chamber, rammed down a bullet in the barrel, then placed a percussion cap on the nipple—at the rear of each chamber—where the hammer would fall on it. In 1854, Eugene Lefaucheux introduced the Model 1854, the first revolver to use self-contained metallic cartridges rather than loose powder, pistol ball, and percussion caps.

In 1889, Colt introduced the Model 1889, the first truly modern double action revolver, which differed from earlier double action revolvers by having a "swing-out" drum, as opposed to a "top-break" or "side-loading" drum. Swing out drums quickly caught on, because they combined the best features of earlier designs. Top-break actions gave the ability to eject all empty shells simultaneously, and exposed all chambers for easy reloading, but having the frame hinged into two halves weakened the gun and negatively affected accuracy, due to lack of rigidity.

However, "side-loaders", like the earlier Colt Model 1871 and 1873, provided a rigid frame, but required the user to eject and load one chamber at a time as they rotated the drum to line up each chamber with the side-mounted loading gate. Smith & Wesson Model 1899 (later known as the Model 10) introduced the new 0.38 special cartridge. The Model 10 went on to become the bestselling handgun of the 20th century, selling 6,000,000 units, and the 0.38 special is still the most popular chambering for revolvers in the world. These new guns incorporated a combined center-pin and ejector rod to lock the drum in position. Most of the revolvers comprised of a frame, revolving drum (which is rotate-ably supported by a frame), plurality of chambers situated in the revolving drum, and a barrel and a grip frame (situated in the back of the whole structure).

Compared to autoloading handguns, a revolver is often much simpler to operate and may have greater reliability. For example, should a semiautomatic pistol fail to fire, clearing the chamber requires manually cycling the action to remove the misfired round, as cycling the action normally depends on the energy produced from firing of a cartridge.

With a revolver, this is not necessary as none of the energy for cycling the revolver comes from the firing of the cartridge, but is supplied by the user either through cocking the hammer or, in a double-action design, by just squeezing the trigger.

DESCRIPTION OF THE DRAWINGS

Embodiments in accordance with the present invention are shown in the drawings and will be described below with reference to the figures, whereby elements having the same effect have been provided with the same reference numerals.

The following is shown.

SUMMARY

In accordance with an aspect, there is provided an apparatus, including an upper frame and lower frame which may be pivotally connected together at the front of the open frame revolver and the upper frame may comprise of a muzzle, a barrel and a hammer axle housing. The handle may be removably connected to the lower frame and a drum housing may be located in between rear parts of the upper frame and the lower frame. The spring assembly and the trigger mechanism could also be located in the cavity of the lower frame, wherein the trigger mechanism through at least one trigger hook may be connected to the spring assembly. The tension axle may be located in the lower frame, wherein the tension axle may on one end and through the tension axle hook be connected to the spring assembly, and on the other may have a female lock. The hammer axle may be supported by a housing of the upper frame, wherein the hammer axle may have a male lock on one end and a hammer head may be attached to the other end of the hammer axle. A firing tip may be located on the hammer head. A drum may be positioned in the drum housing, wherein the drum may be pivotally supported by the hammer axle, and the drum may have a slotted housing at the radial center of the drum and may have a plurality of a spaced apart cartridge chambers. A safety lock and a frame lock may be located in the lower frame.

DESCRIPTION

Exemplified embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

Figure 1:
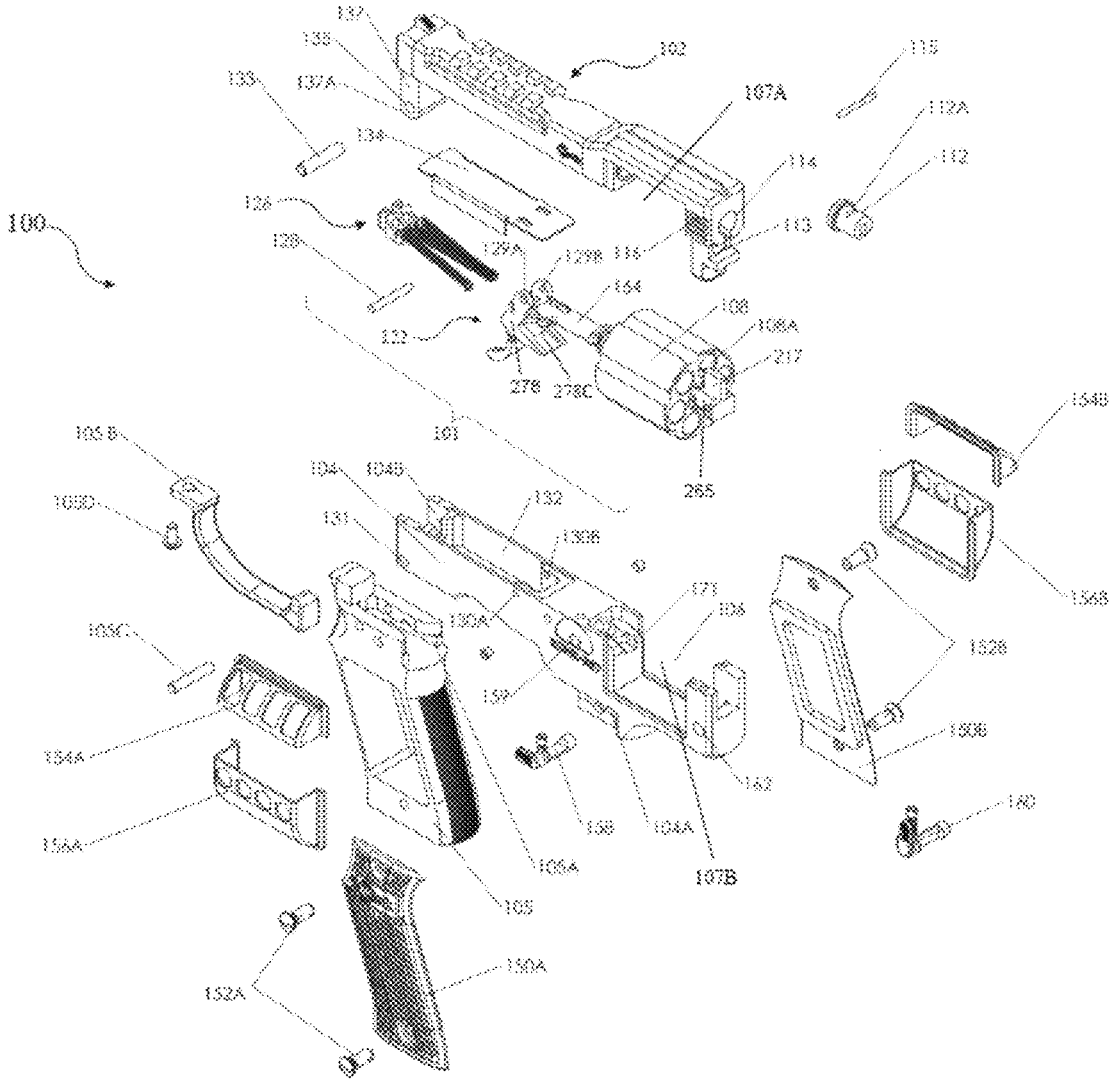
FIG. 1 shows an exploded view of the revolver.

FIG. 1 exemplifies an exploded view of an embodiment of the revolver 100. Revolver 100 may incorporate an upper frame 102 and a lower frame 104, pivotally connected together by aligning a lower frame pin housing 131 with an upper frame pin housing 135 and inserting through them a pin 133. The handle 105 removably attached to the lower part of lower frame 104. The upper frame 102 and the lower frame 104 form a drum housing 106 for housing a drum 108, which is part of the inner firing assembly 101. The drum housing 106, located near the rear end of the revolver 100, is formed of two separate parts: the upper drum housing 107A, which is located in the upper frame 102, and the lower drum housing 107B, which is located in the lower frame 104. A barrel 110, (shown in FIGS. 5A and 2D) longitudinally positioned in the upper frame 102 of the revolver 100.

The trigger mechanism 122 is operatively connected to the tension axle 164 (further discussed below), wherein the tension axle 164 in its turn may be mated with a hammer axle 265 (also shown in FIGS. 2A-2D). The hammer axle 265 may be connected to the hammer head 217 (also shown in FIG. 2A) and is able to strike the back of the cartridge located in the upper most chamber of the plurality of spaced-apart cartridge chambers 108A of drum 108 which causes firing of the cartridge round. The hammer axle 265 is partially inserted into the upper frame 102 through the housing 113 which is located in the back portion of the upper frame 102.

Figure 5A:
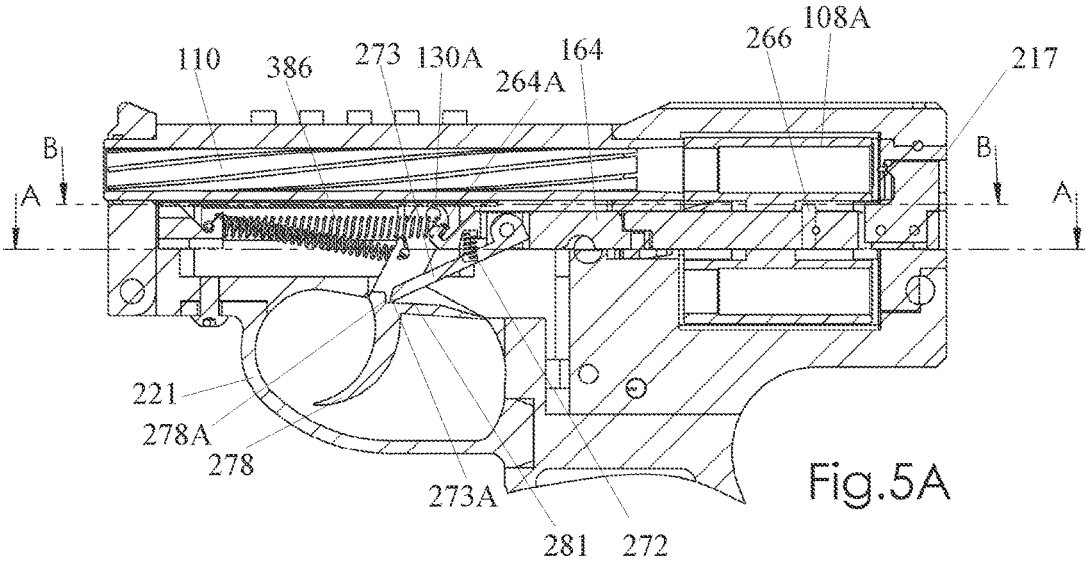
FIGS. 5A, 6A, 7A, 8A and 9A show side cross-sectional views of the revolver's inner firing assembly in different operational phases.
Figure 5B:
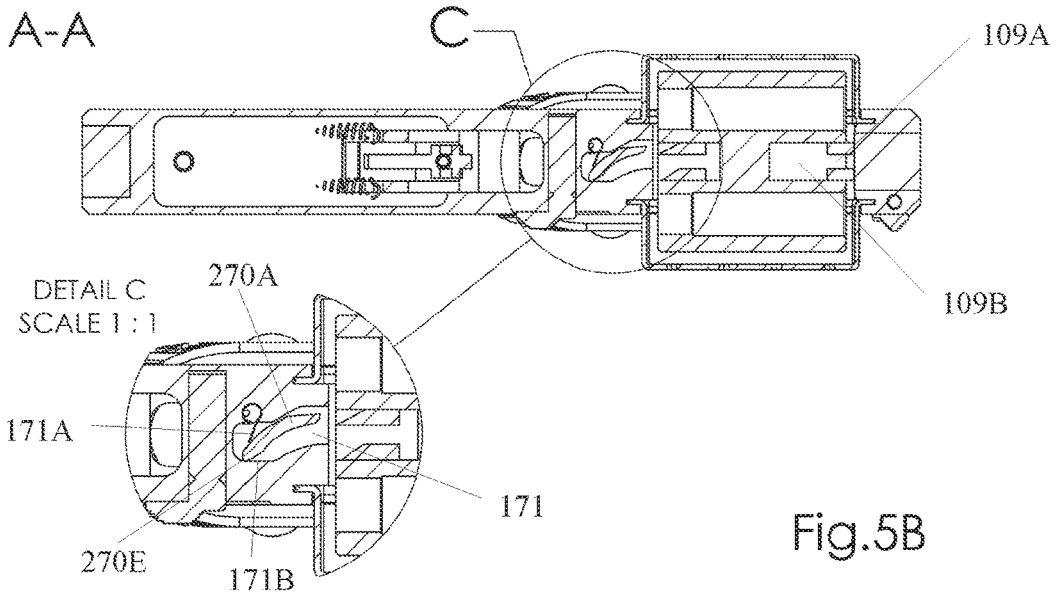
FIGS. 5B, 6B, 7B, 8B and 9B shows top-down cross-sectional views of the revolver's inner firing assembly in different operational phases.
Figure 5C:
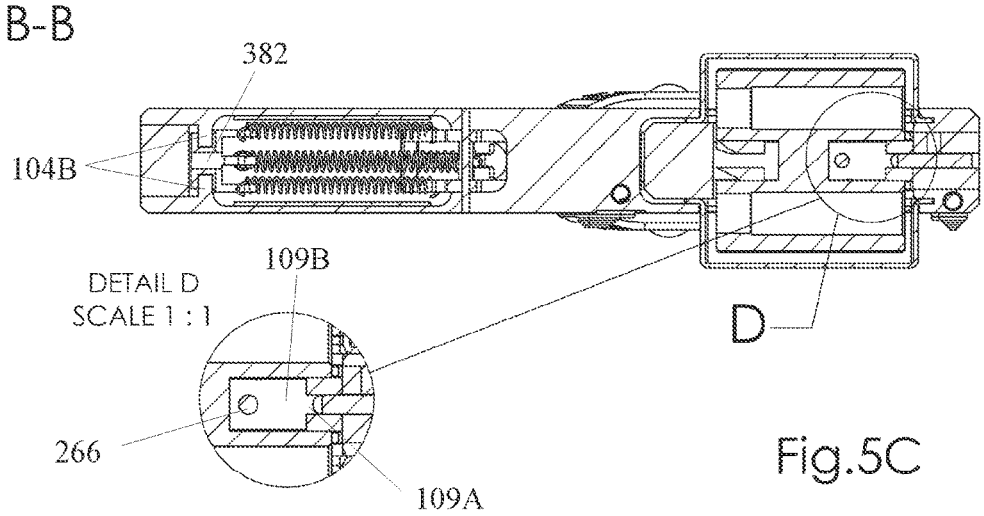
FIGS. 5C, 6C, 7C, 8C and 9C shows top-down cross-sectional views of the revolver's inner firing assembly in different operational phases.

The spring assembly 126, on its one end, may be connected to the lower frame 104 by sliding spring bracket 382 (shown in FIG. 3A) into bracket housing 104B (also shown in FIG. 5C). The other end of the spring assembly 126 is connected to the tension axle 164 and trigger mechanism 122 (shown in FIGS. 3C and 3D). Trigger 278 (also shown in FIG. 2A) of trigger mechanism 122 may be pivotally connected to the lower frame 104 by means of pin 128 which may be inserted through corresponding pivot center 130A into the corresponding pin housings 129A and 129B and corresponding pivot center 130B. The inner firing assembly 101 is partially located in the cavity 132 of the lower frame 104 and is covered with plate 134 that is fixed to the lower frame 104.

The pivotal movement of the upper frame 102 compared to the lower frame 104 may be limited by means of a limiting surface 137A (also shown in 2D) located on a swivel arm 137 (further discussed below). Swivel arm 137 extends downward from the muzzle 102C (shown in FIG. 14A). The firing tip guider 112 may be inserted into the firing tip guiding housing 114 from the inner part of the upper drum housing 1074 and fixed in position by inserting the fixing pin 115 into pin housing 116, passing through the fixing channel 112A. The handle 105 incorporates handgrips 150A and 150B attached through sets of screws 152A and 152B to the handle 105 accordingly from the left and right sides. The upper left drum cover 154A and the upper right drum cover 154B are attached to the upper drum housing 1074, located on the upper frame 102, from the left and right sides. The lower left drum cover 156A and the lower right drum cover 156B are attached to the lower drum housing 107B, located on the lower frame 104, from the left and right sides. Safety lock 158 may be located in the safety lock housing 159 and the frame lock 160 may be located in the lower frame 104 lock housing 162.

Figure 2A:
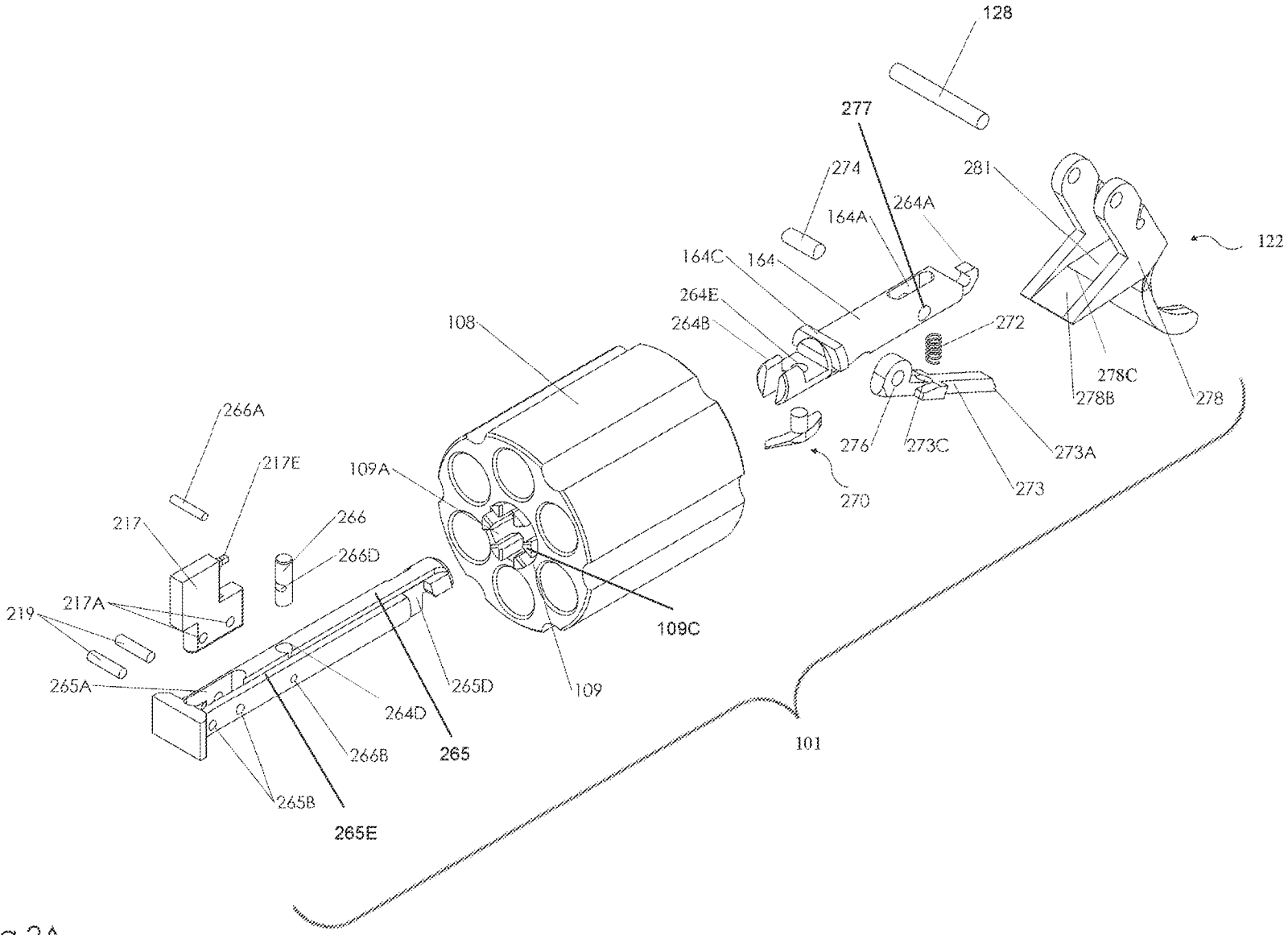
FIG. 2A shows an exploded view of the inner firing assembly.
Figure 2B:
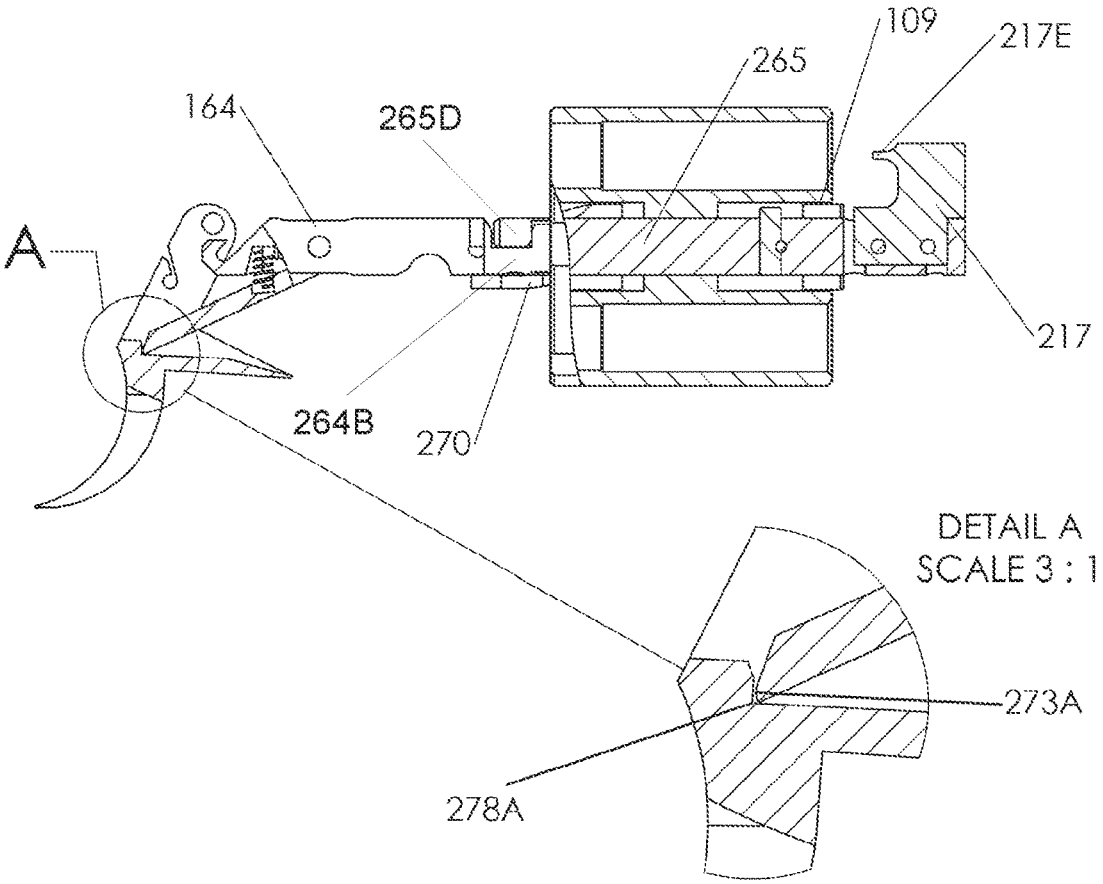
FIG. 2B shows a side view and partial cross-sectional view of the inner firing assembly.
Figure 2C:
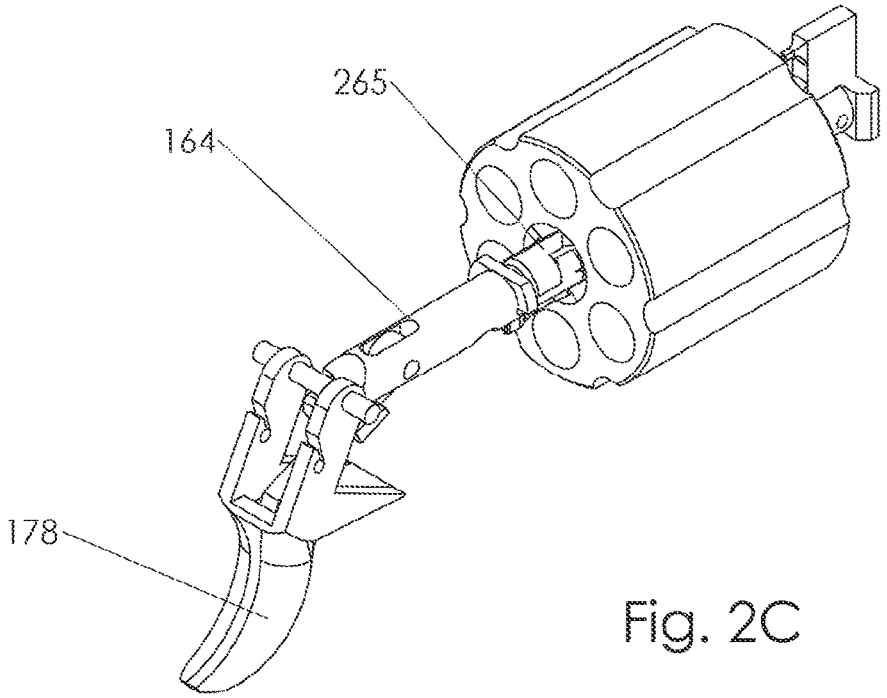
FIG. 2C shows a perspective view of the inner firing assembly.
Figure 2D:
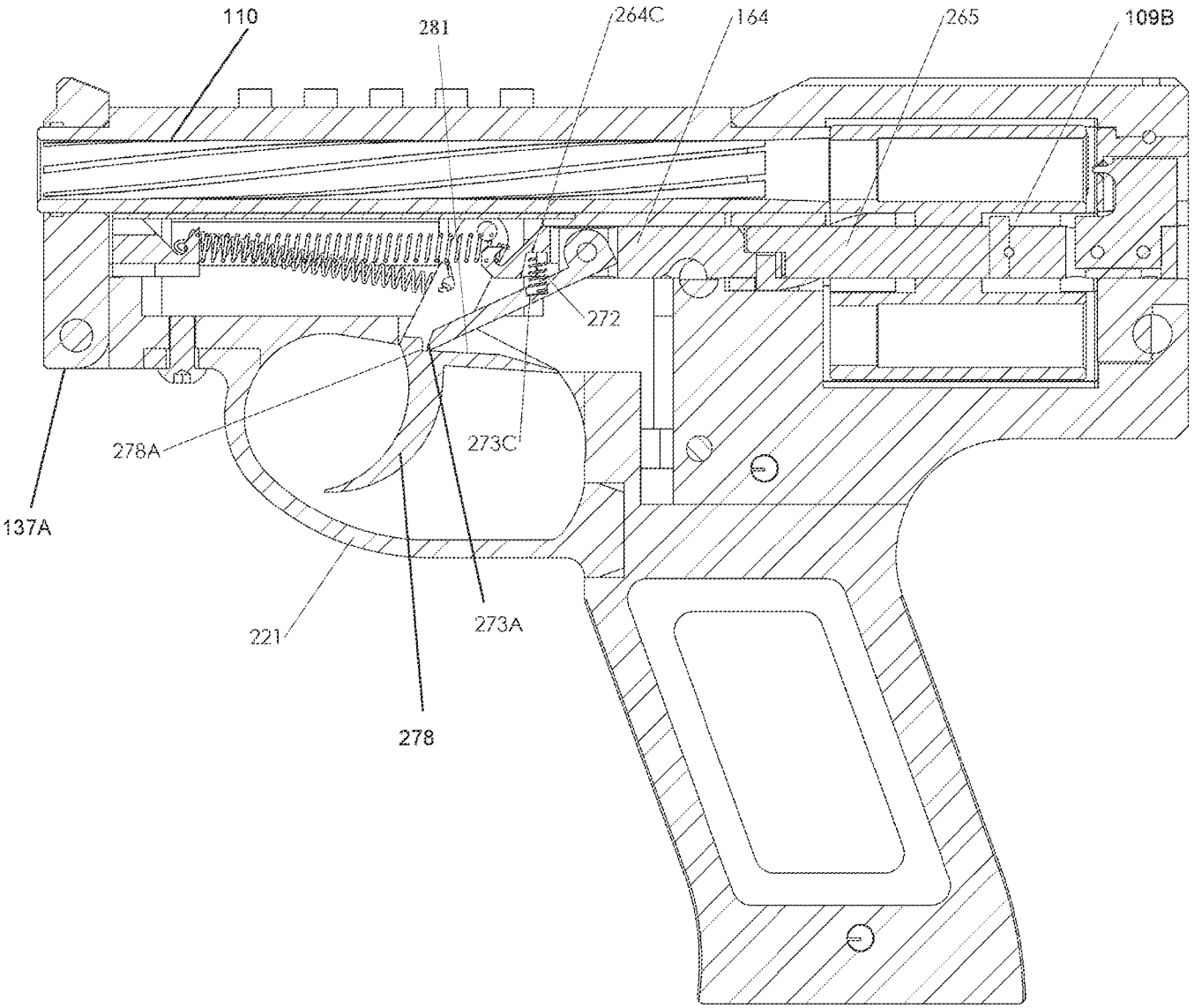
FIG. 2D shows a side cross-sectional view of the revolver.
Figure 2E:
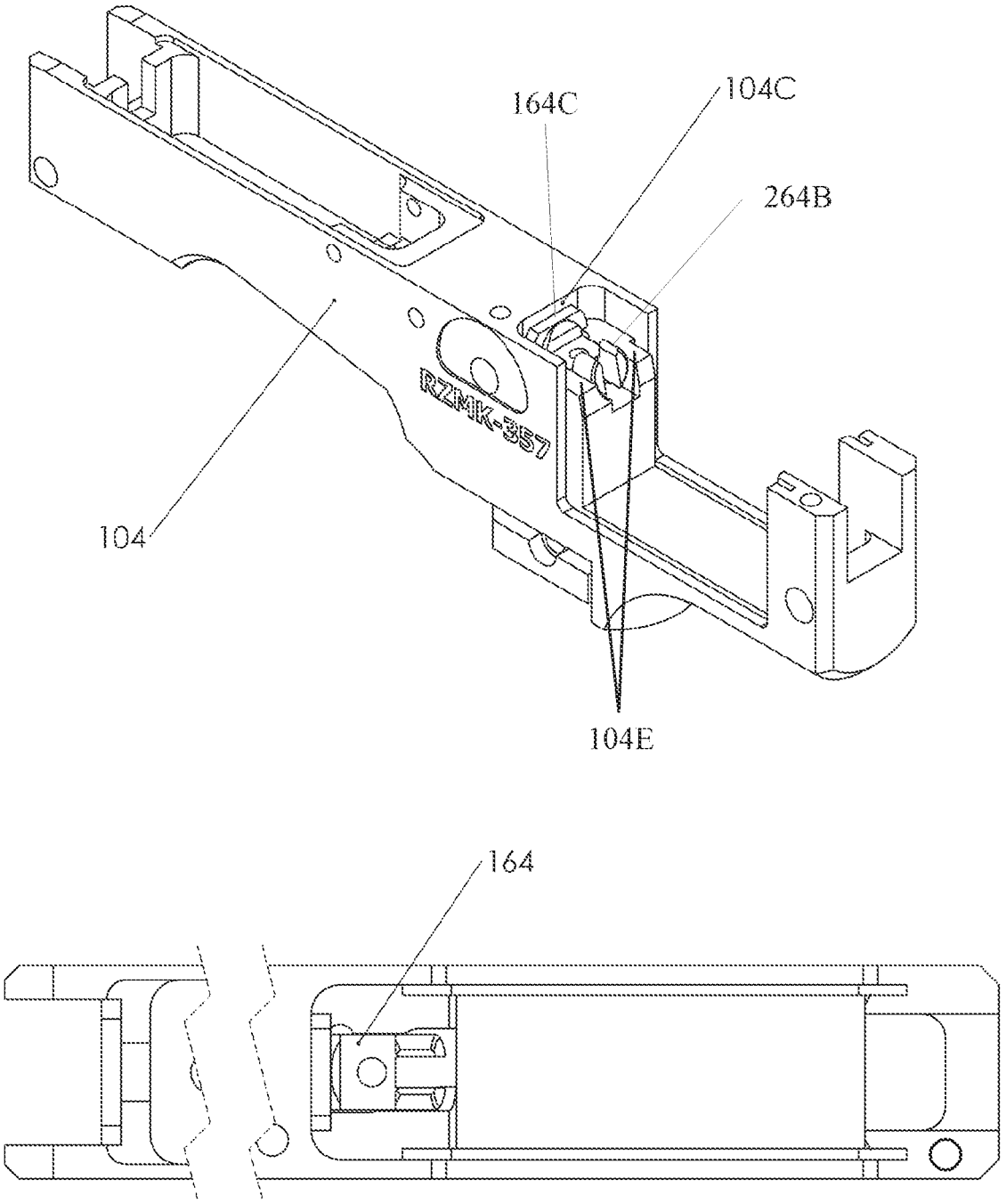
FIG. 2E shows left perspective view top view of lower frame.
Figure 2F:
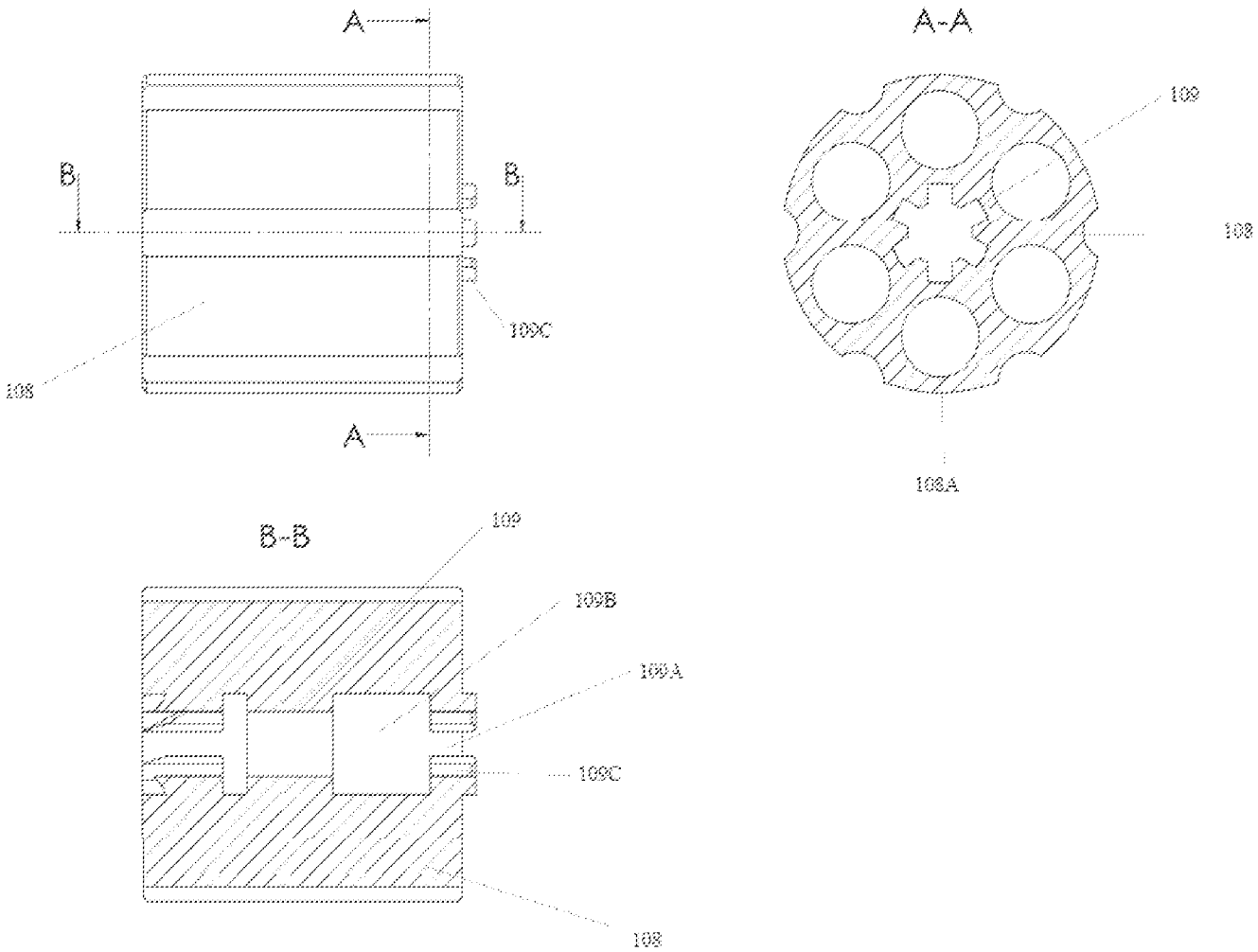
FIG. 2F shows a side view, front-rear cross-sectional view, and top-down cross-sectional view of the drum.

FIG. 2A exemplifies an exploded view of an inner firing assembly 101 of the revolver 100. Hammer head 217 may have a hammer head pin housings 217A and firing tip 217E. Hammer head 217 may be fixed to the hammer axle 265 by mating the lower part of the hammer head 217 with the hammer axle cavity 265A, aligning hammer head pin housings 217A with hammer axle pin housings 265B and inserting pins 219 through hammer axle pin housings 265B into the hammer head pin housings 217A. Drum 108 may be pivotally supported by the hammer axle 265 by inserting the hammer axle 265 into slotted housing 109. Plurality of side walls 109C (also shown in FIG. 2F) protrude from back of the drum 108.

Trigger mechanism 122 may operationally engage with sear 273 and compression spring 272. Sear 273 is pivotally connected to the tension axle 164 by inserting the upper part of the sear 273 into the tension axle cavity 164A, located at the bottom part of the tension axle 164, aligning pivot pin housing 276 with pivot pin housing 277 and inserting through them a pivot pin 274. Sear 273 is pushed downward under the influence of the compression spring 272, wherein the lower part of the compression spring 272 sits on sear seat 273C (also shown in FIG. 2D) while the upper part of the compression spring 272 sits in the tension axle spring seat 264C (shown in FIG. 2D). Trigger 278 is pivotally connected to the lower frame 104 by means of pin 128 (shown in FIG. 1, discussed above), such that the lower part—finger engageable portion of the trigger 278—is movable backwards from a resting position, in a conventional manner relative to the lower frame 104. To limit unwarranted forward advancement of tension axle 164 and fix the favorable position of the tension axle 164 in relation to the lower frame 104 in the resting position of the trigger 278—phase 1—(further discussed below), the protrusion 164C may be located on the surface of the tension axle 164, such that the intermediate wall 104C (shown in FIG. 2E) may prevent the forward advancement of the tension axle 164 by making contact with the protrusion 164C. Protrusion 164C also limits unwarranted rotational movement of tension axle 164 around its longitudinal axis by making contact with surface 104E. Protrusion 164C may also prevent movement of the tension axle 164, the hammer axle 265, and the hammer head 217, under the influence of the spring assembly 126.

Tension on the trigger 278 is provided by the spring assembly 126 (shown in FIGS. 1 and 3A) and specifically through trigger springs 386A and 386B (shown in FIG. 3C) connected to the trigger 278 (further discussed below). Thus, the function of the trigger springs 386A and 386B are to keep the trigger 278 tensioned towards the front portion of the trigger guard 221 (shown in FIG. 2D). Trigger 278 is also indirectly connected with the hammer head 217 through means of the hammer axle 265, tension axle 164, and sear 273 which collectively control the movement of the firing tip 217E in response to the movement of the trigger 278. Sear 273 comes in contact with the trigger 278 as the sear tip 273A (which is located opposite to the pivot pin housing 276 of the sear 273) may engage with sear slot 281 (also shown in FIG. 2D), such that in the resting position of the trigger's 278 sear tip 273A (shown in FIG. 2D) may rest on sear slot 281.

Tension axle 164 and hammer axle 265 could be locked together by mating the male lock 265D with the female lock 264B (shown in FIGS. 2A, 2B, and 2C) in such a way that the longitudinal axis of tension axle 164 and the longitudinal axis of hammer axle 265 are aligned. Once aligned and communicatively engaged with one another, tension axle 164 and hammer axle 265, make up a "single" axle. To limit unwarranted backward movement of hammer axle 265, limiting pin 102D (shown in FIG. 13C) may be inserted into limiting pin housing 102E (shown in FIGS. 14B and 14C) located on the back part of the upper frame 102. The protruding part of the limiting pin 102D will be positioned in the limiting pin channel 265E (shown in FIG. 14C) and may prevent removal of hammer axle 265 from the upper frame 102 by making contact with the front end (near to male lock 265D) of limiting pin channel 265E (shown in FIG. 2A) located on hammer axle 265. Guiding pin 266 may be positioned on the top surface of hammer axle 265 such that the guiding pin 266 is inserted into guiding pin housing 264D. The protruding part of and guiding pin 266 from the hammer axle 265 may be fixed in the position by inserting fixing pin 266A into fixing pin housing 266B, passing through the fixing channel 266D.

Figure 3A:
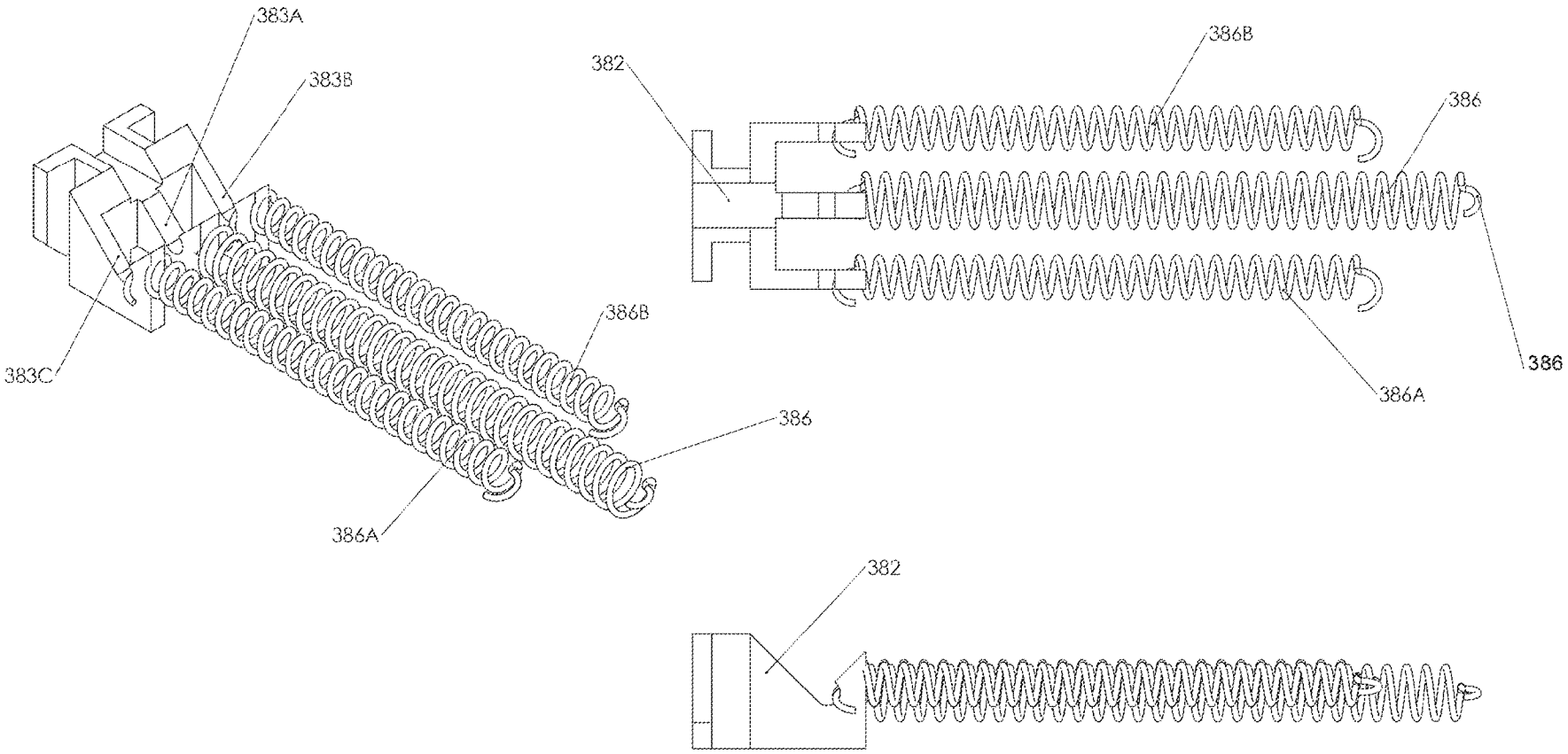
FIG. 3A shows a side, top and perspective view of the spring assembly.
Figure 3B:
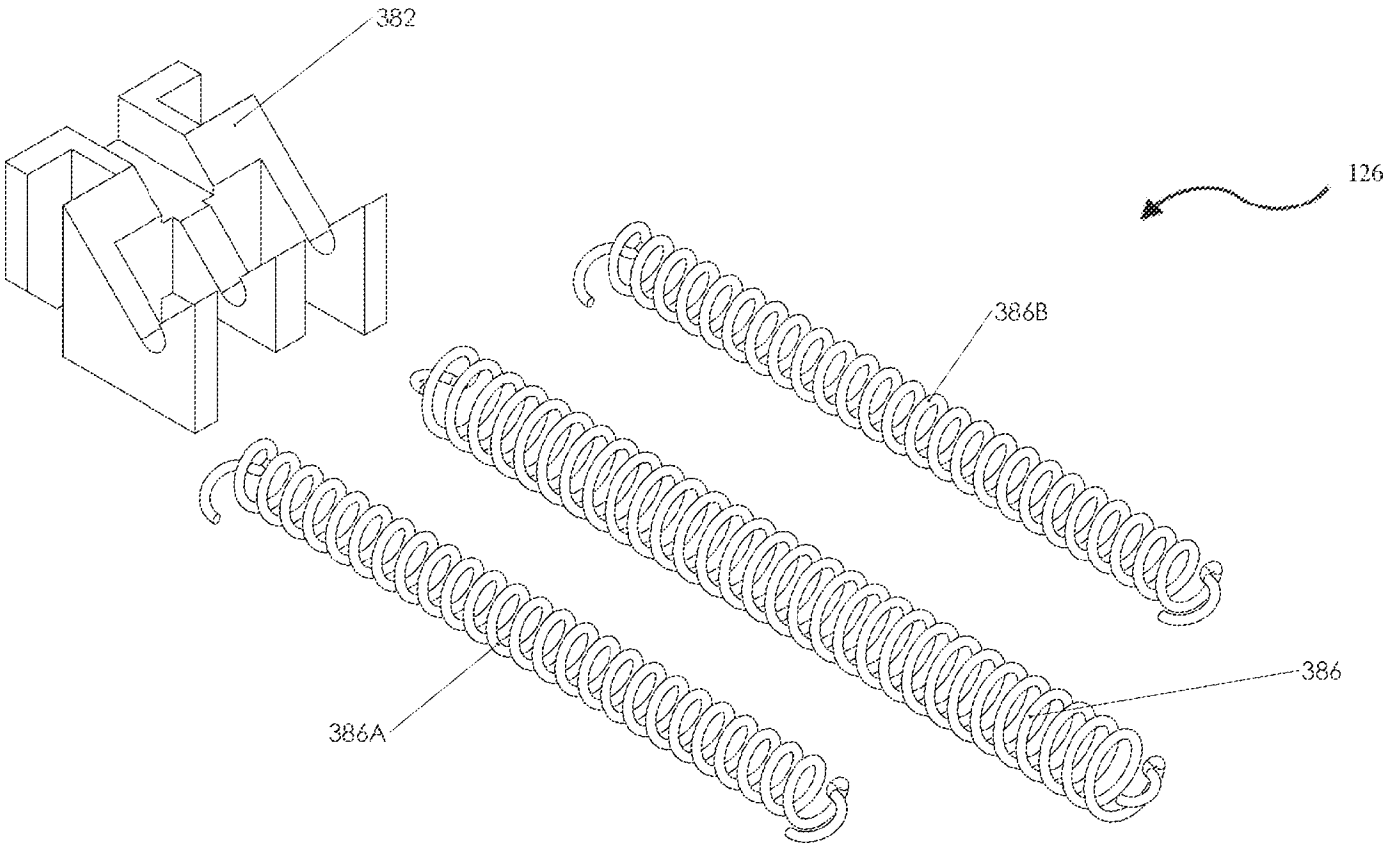
FIG. 3B shows an exploded view of the spring assembly.
Figure 3C:
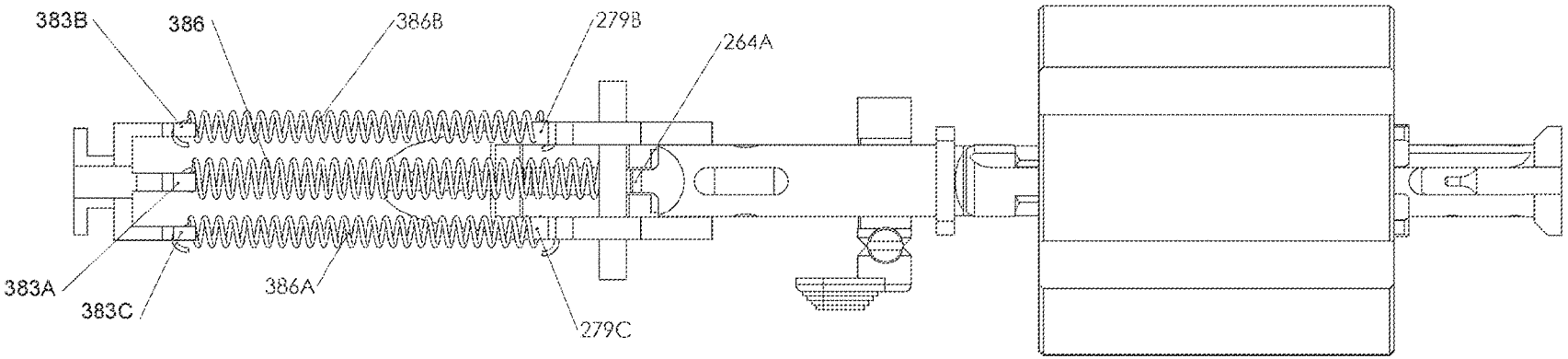
FIG. 3C shows a top view of the spring assembly.
Figure 3D:
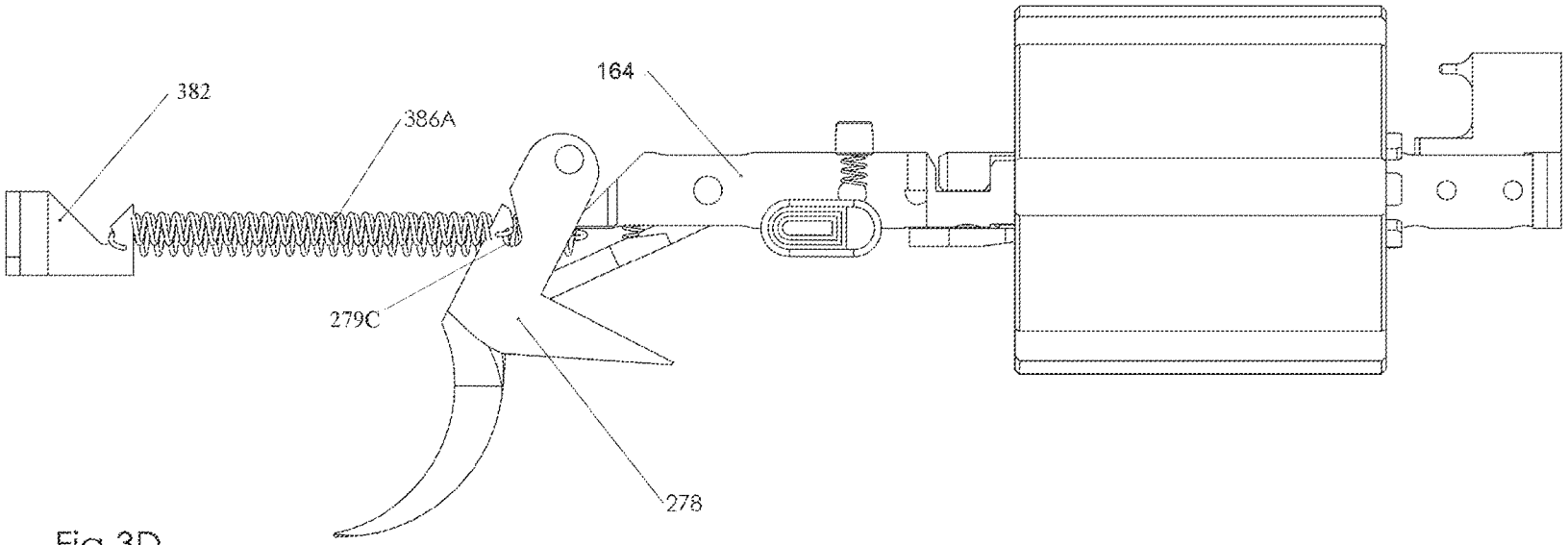
FIG. 3D shows a side view of the spring assembly.

FIG. 3A exemplifies a top, side, and perspective views of the spring assembly 126. The spring assembly 126 may incorporate spring bracket 382. Spring bracket 382 may include a tension axle spring hook 383A and trigger spring hooks 383C and 383B. One end of the trigger spring 386A may be connected to the trigger spring hook 383C while the other end of the trigger spring 386A could be connected to trigger hook 279C (shown in FIG. 3C). One end of the other trigger springs 386B could be connected to the trigger spring hook 383B while the other end of trigger spring 386B could be connected to the trigger hook 279B (shown in FIG. 3C). One end of the tension spring 386 could be connected tension axle spring hook 383A, while the other end, could be connected to the tension axle hook 264A.

FIG. 3A exemplifies elevated perspective view of spring assembly 126, showing spring bracket 382, trigger spring 386A, trigger spring 386B and tension spring 386.

Figure 4B:
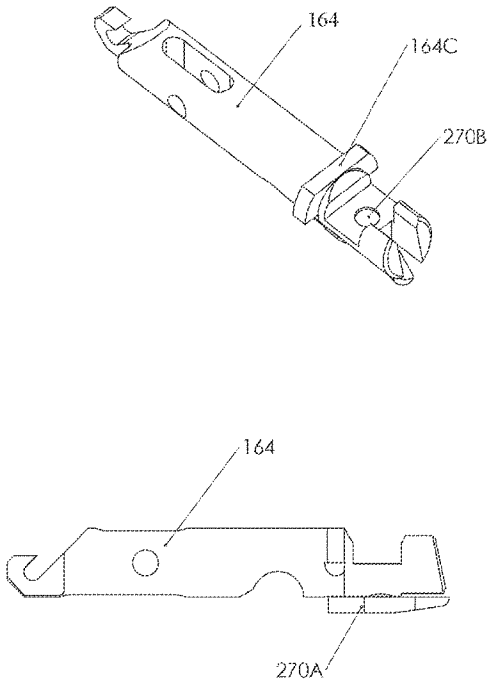
FIGS. 4A, 4B show perspective and side views of the tension axle and rotation foot.
Figure 4A:
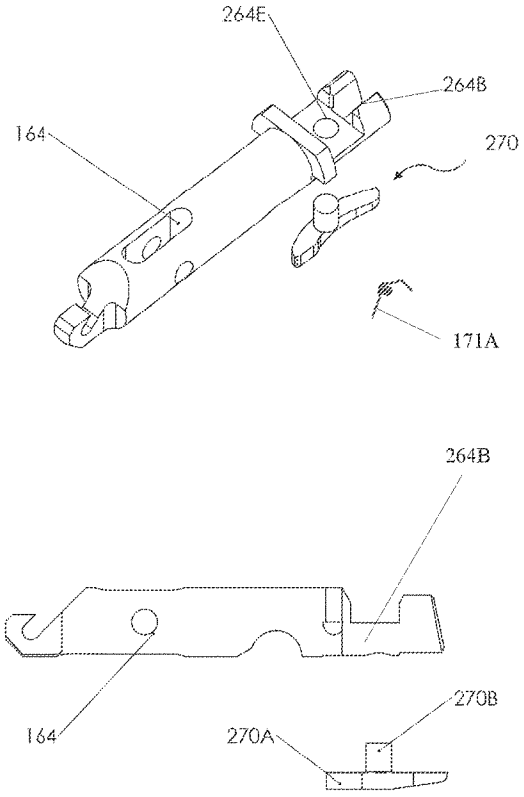

FIG. 4A exemplifies both, an elevated perspective and side views of the tension axle 164, an elevated perspective and side views of the rotation foot 270 and guiding spring 171A. Tension axle 164 may include female lock 264B which may have rotation foot housing 264E. Rotation foot housing 264E may have a cylindrical form and the longitudinal axis of the rotation foot housing 264E is perpendicular to the longitudinal axis of tension axle 164. Rotation foot 270 has at its lower part a guider head 270A which may have an irregular shape (shown in FIG. 4A) and in an upper part, cylindrical body 270B.

Cylindrical body 270B may protrude upwardly from the guider head 270A. The cylindrical body 270B may have a maximum length limited by the of the depth of the rotation foot housing 264E, and a diameter size snug enough to allow free rotation of rotation foot 270 inside of the rotation foot housing 264E.

FIGS. 5A, 6A, 7A, 8A, and 9A exemplify cross-sectional side views of the revolver 100 and its trigger's 278 operational phases while FIGS. 5B, 6B, 7B, 8B and 9B exemplify top cross-sectional views of the rotation foot 270 in various operational phases. FIGS. 5C, 6C, 7C, 8C exemplify top cross-sectional views of the guiding pin 266 in various operational phases.

FIG. 5A shows trigger 278 in a resting position (no force applied on the trigger) roughly in the middle of the trigger guard 221, phase 1 (most forward position of the trigger). Sear tip 273A (also shown in FIGS. 6A, 7A, 8A, 9A) under the influence of compression spring 272 may be engaged with sear slot 281 (also shown in FIGS. 2D, 7A). Hammer head 217 in FIGS. 5A and 5B are shown in the resting position (phase 1).

FIG. 5B shows a top-down cross-sectional views of the revolver's inside cut along the line A-A (cut shown relative to FIG. 5A). Specifically, FIG. 5B shows guider head 270A in a resting position (phase 1), located in the rotation foot chamber 171 which is located in the lower frame 104 (also shown in FIG. 1). The guiding spring 171A is located in the rotation foot chamber 171 in such a way that the guiding spring 171A may be engaged with guider head 270A at the guider head's 270A rear tip 270E. The influence of guider spring 171A may force the rotation foot chamber 171 towards the side wall 171B.

FIG. 5C shows a top-down cross-sectional views of the revolver's inside cut along the line B-B (cut shown relative to FIG. 5A). Specifically, FIG. 5C shows guiding pin 266 in a resting position (phase 1), located in the drum cavity 109B, that may not be engaged with one of the plurality of drum slots 109A.

Figure 6A:
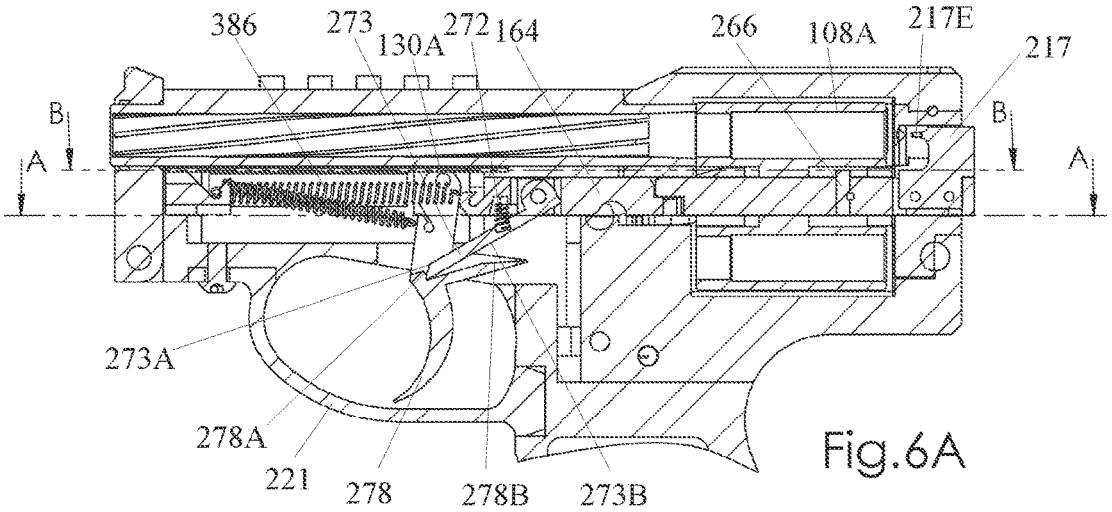

FIG. 6A shows trigger 278 in a biased position toward the back portion of the trigger guard 221, (phase 2), such that the trigger 278 may be pulled away from the tip of the revolver 100 under the pressure of a finger. Because of abovementioned movement, trigger 278 may be pivotally moved back toward the back portion of the trigger guard 221—due in part to the pivot centers 130A and 130B (not shown here)—and the hold notch 278A may have a circular-upward motion. Because compression spring 272 (also shown in FIG. 2D) may push sear 273 toward the trigger 278, hold notch 278A and sear tip 273A in phase 2 may be engaged; so that backward movement of the trigger 278 would be transferred to the tension axle 164, which may increase influence of tension spring 386 on tension axle 164. The further that the trigger 278 is moved back, the more tension is transferred on the axle 164. At the same time, the more the hammer head 217 moves away from the back portion of the upper frame 102 means more gap is opened between firing tip 217E (also shown in FIG. 7A) and the drum 108, and the gap between angular surface 278B and underside surface 273B of sear 273 may be decreased. Because of tension spring's 386 influence on tension axle 164, which is transferred to the sear 273, the sear tip 273A abuts the hold notch 278B.

Figure 6B:
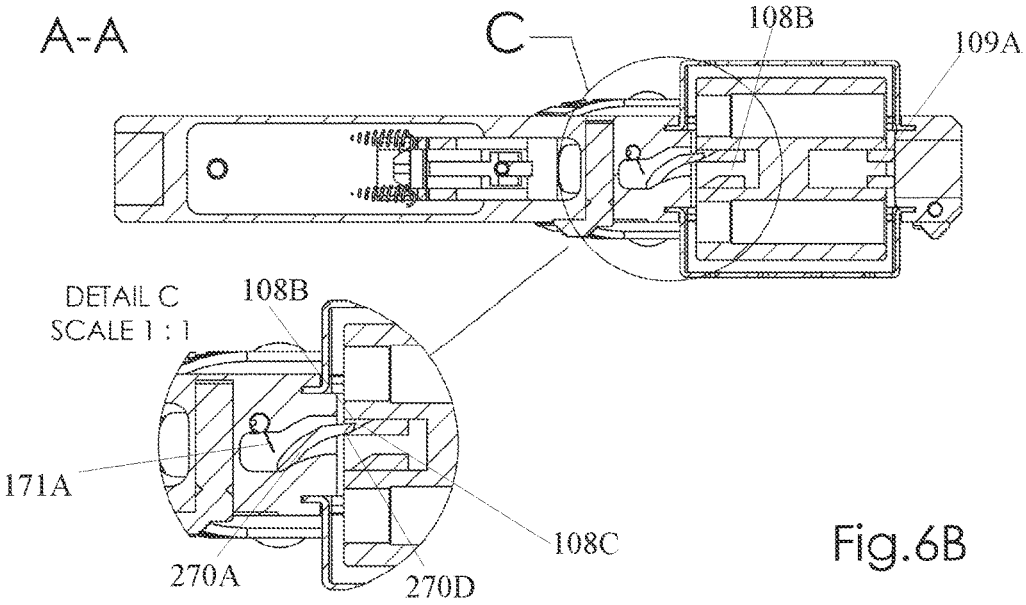

FIG. 6B shows a top-down cross-sectional views of the revolver's inside cut along the line A-A (cut shown relative to FIG. 6A). Specifically, FIG. 6B shows the orientation of the guider head 270A as it moves backward with the tension axle 164 (shown in FIG. 6A). By moving backwards, front tip of the guider head 270A—in phase 2—may be engaged with one of the plurality of rotation slots 108B. The front tip 270D of the guider head 270A and the sloped surface 108C of one of the plurality of rotation slots 108B come into contact with one another. Because the drum 108 is pivotally supported by the hammer axle 265, the further the guider head 270A moves back into in one of the plurality of rotation slots 108B, the more the front tip 270D of the guider head 270A comes into contact with the sloped surface 108C causing the sliding action which forces the drum 108 to rotate. The guiding spring 171A thus disengages with the rotation foot 270 in phase 2.

Figure 6C:
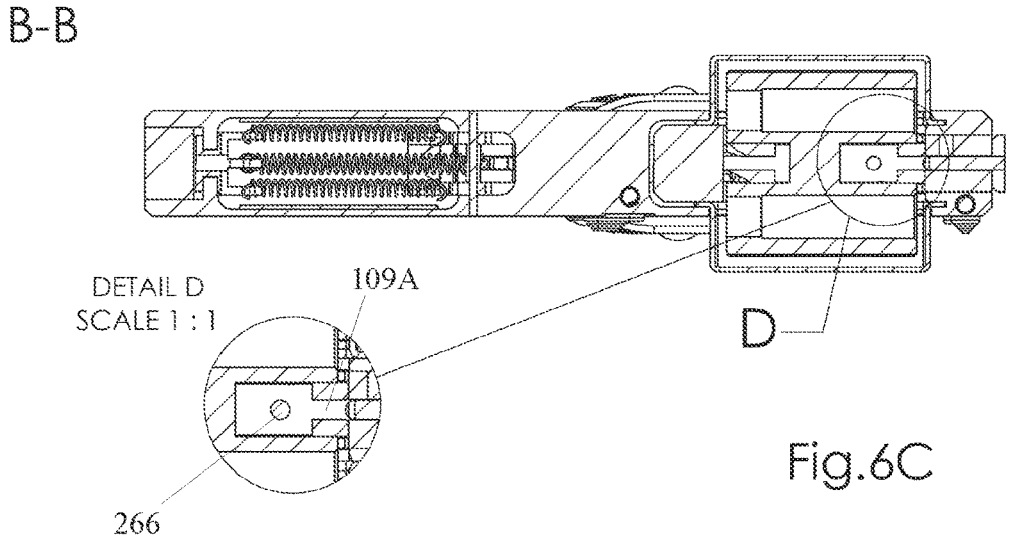

FIG. 6C shows a top-down cross-sectional views of the revolver's inside cut along the line B-B (cut shown relative to FIG. 6A). Specifically, FIG. 6C shows guiding pin 266 moved backwards toward one of the plurality of drum slots 109A.

Figure 7A:
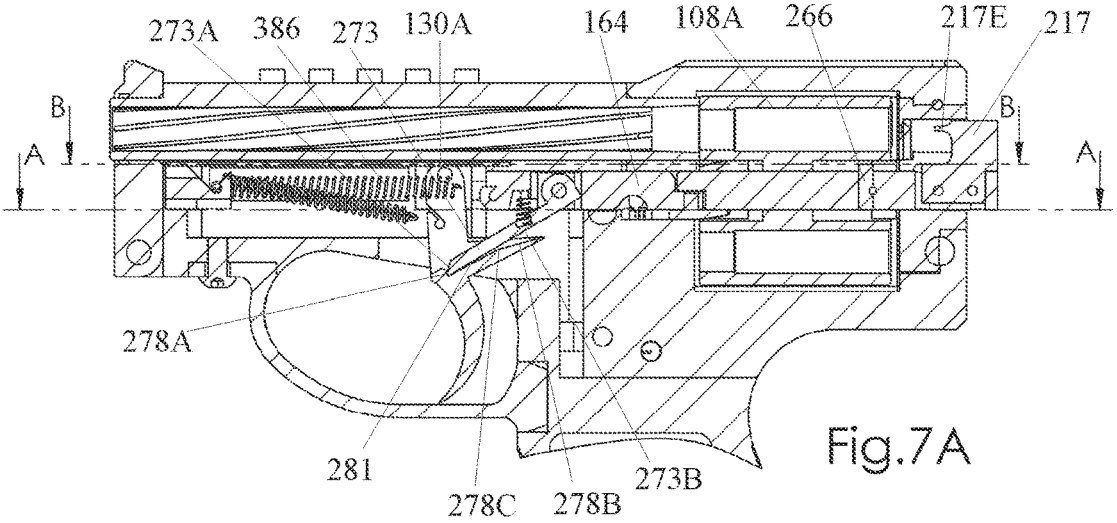

FIG. 7A shows trigger 278 in a further biased position toward the trigger guard 221, mid-way position (phase 3). For the same reason as discussed above, hold notch 278A and sear tip 273A in phase 3 may still be engaged together, even though trigger 278 moved further back. Tension axle 164 also may move further back by the further increasing influence of tension spring 386. Hammer head 217 may move further away from the back portion of the upper frame 102, increasing the gap between firing tip 217E and the upper most of plurality of the spaced apart cartridge chambers 108A. The gap between sear slot 281 and underside surface 273B may be decreased to the point that the breaking line 278C (also shown in FIGS. 1 and 2A) of trigger 278 may at some point contact the underside surface 273B.

Figure 7B:
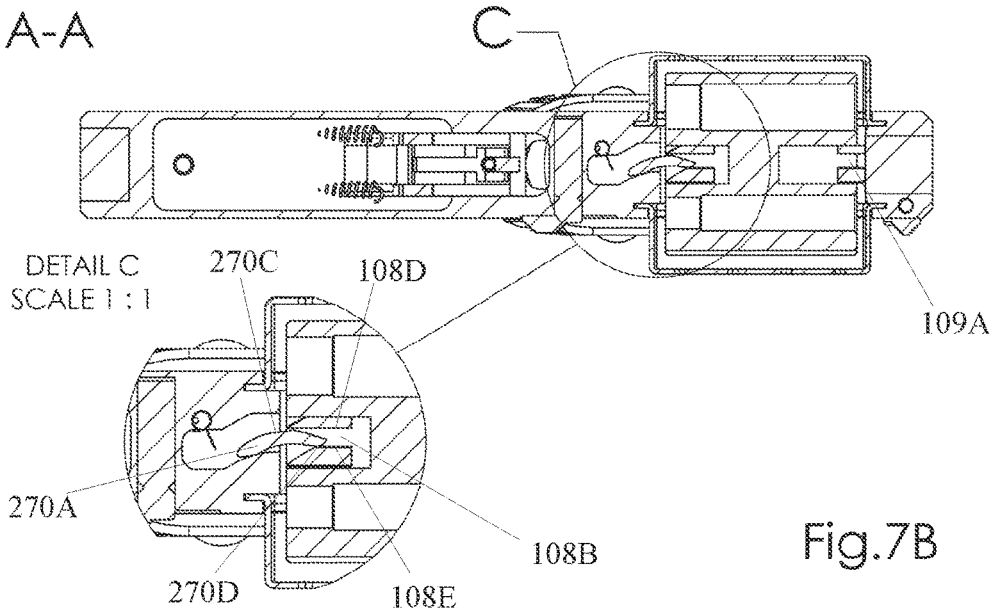

FIG. 7B shows a top-down cross-sectional views of the revolver's inside cut along the line A-A (cut shown relative to FIG. 7A). Specifically, FIG. 7B shows that the front tip 270D of the guider head 270A may continue backward movement into in one of the plurality of rotation slots 108B and in some moment in phase 3, the front tip 270D may be engaged with flat surface 108E while the flat surface 270C of the guider head 270A may be engaged with the flat surface 108D of the one of the plurality of rotation slots 108B. This movement of the guider head 270A may initiate a further rotational movement of the drum 108.

Figure 7C:
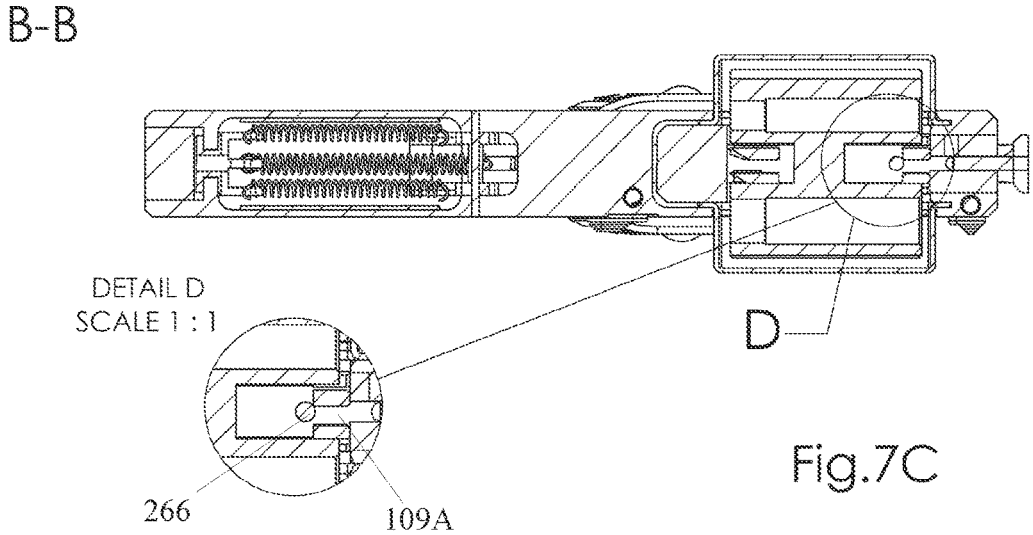

FIG. 7C shows a top-down cross-sectional views of the revolver's inside cut along the line B-B (cut shown relative to FIG. 7A). Specifically, FIG. 7C shows guiding pin 266 further moved backwards and because of drum 108 continues rotation, guiding pin 266 may head into one of the plurality of drum slots 109A (phase 3).

Figure 8A:
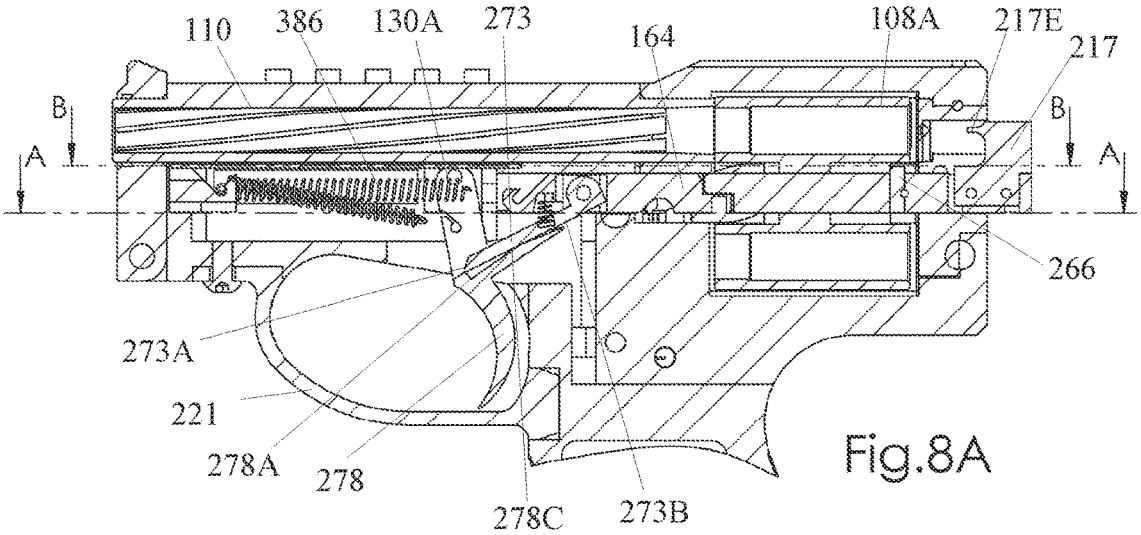

FIG. 8A shows trigger 278 in a position where it is almost touching the back portion of the trigger guard 221 (phase 4). Because trigger 278 continues its pivotal movement around the pivot center 130A, the breaking line 278C (shown in FIG. 7A) comes into contact with underside surface 273B (shown in FIG. 7A). The sear tip 273A may start upward movement as it is abutted to the hold notch 278A but in phase 4 may still be engaged with the hold notch 278A. The gap between the angular surface 278B (shown in FIG. 7A) and underside surface 273B may decrease. Tension axle 164 also may stop moving further backward and the influence of tension spring 386 may not further increase. Hammer head 217 may not move further away from the back portion of the upper frame 102, and the gap between firing tip 217E and the upper most of plurality of spaced apart cartridge chambers 108A may not further increase. In phase 4, guider head 270A no longer rotates the drum 108.

Figure 8B:
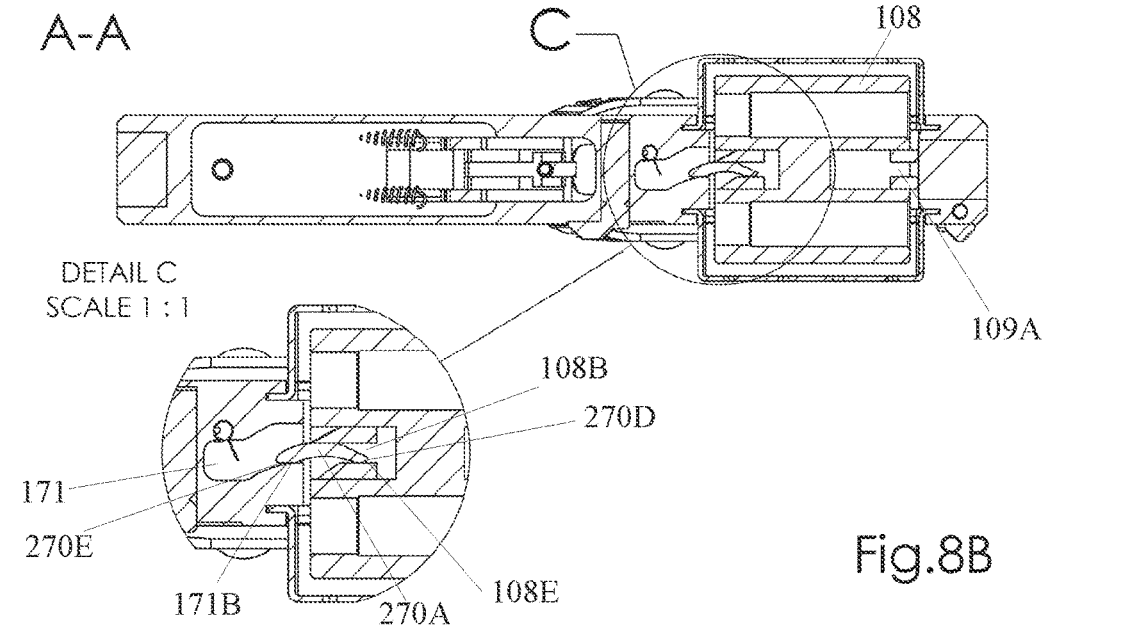

FIG. 8B shows a top-down cross-sectional views of the revolver's inside cut along the line A-A (cut shown relative to FIG. 8A). Specifically, FIG. 8B shows the guider head 270A further moved backward and positioned inside one of the plurality of rotation slots 108B, wherein the front tip 270D may be engaged with flat surface 108E, while flat surface 270C (shown in FIG. 7B) may be engaged with flat surface 108D, and rear tip 270E may be engaged with side wall 171B. The longitudinal axis of the upper most of plurality of spaced apart cartridge chambers 108A may be aligned with longitudinal axis of barrel 110.

Figure 8C:
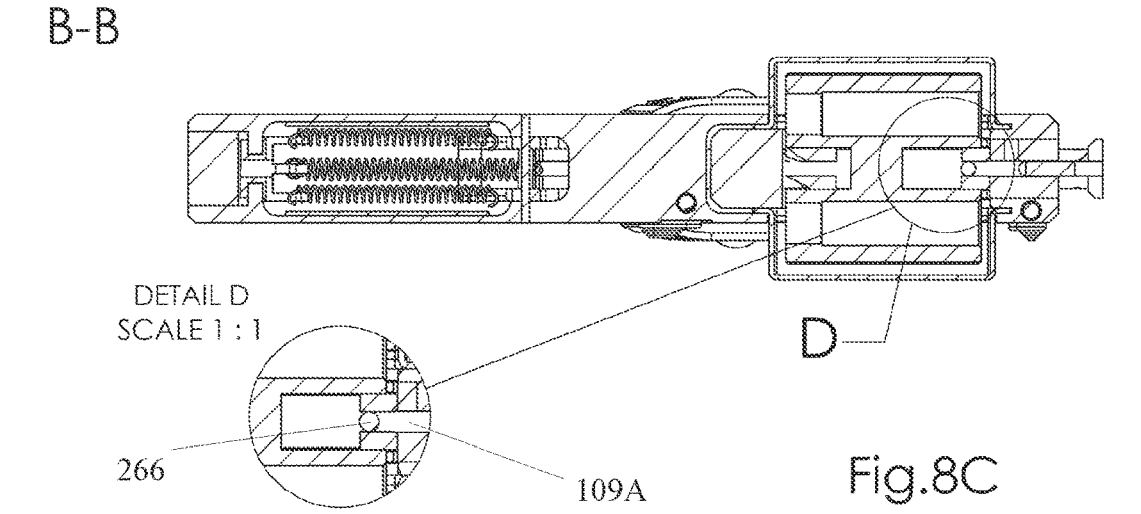

FIG. 8C shows a top-down cross-sectional views of the revolver's inside cut along the line B-B (cut shown relative to FIG. 8A). Specifically, FIG. 8C shows guiding pin 266 may be further moved backward and fully engaged with one of the plurality of drum slots 109A (phase 4).

Figure 9A:
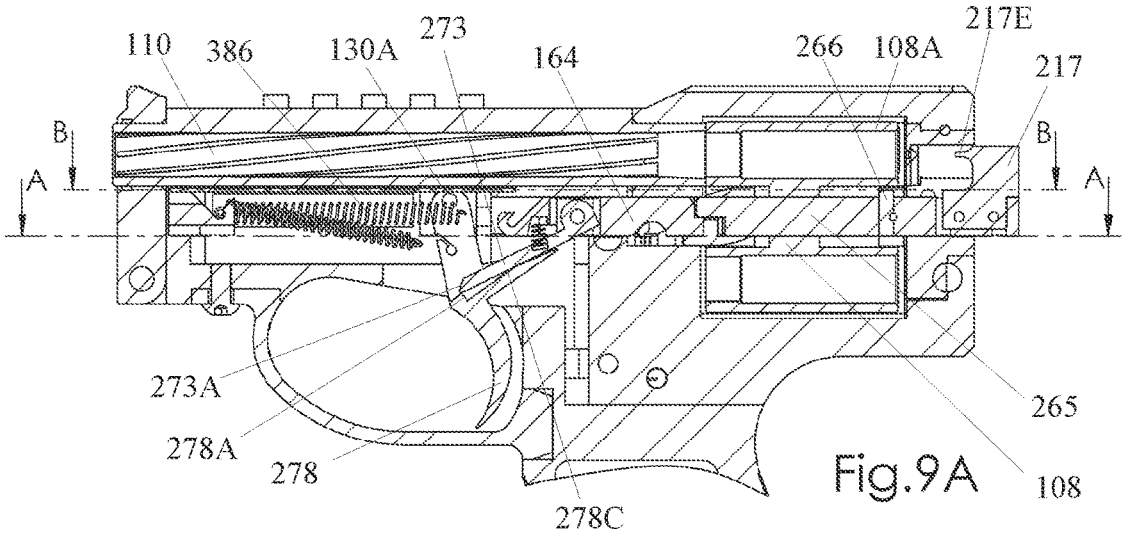

FIG. 9A shows the trigger 278 in its most backside firing position (phase 5). Because trigger 278 continues its pivotal motion around the pivot center 130A and 130B (not shown here), the breaking line 278C (shown in FIG. 7A) at some point of phase 5 may push the underside surface 273B (shown in FIG. 7A) further up, releasing sear tip 273A from engagement with hold notch 278A. Tension axle 164 and hammer axle 265 at this point are under influence of the tension spring 386 which moves toward the front portion of the revolver 100. Hammer head 217 may also move toward drum 108, under the influence of tension spring 386, while the gap between firing tip 217E and the upper most of plurality of spaced apart cartridge chambers 108A may quickly decrease. Eventually, the firing tip 217E may hit the back of the cartridge located in the upper most of plurality of spaced apart cartridge chambers 108A, thereby causing an explosion and ejection of the projectile from the barrel 110.

Figure 9B:
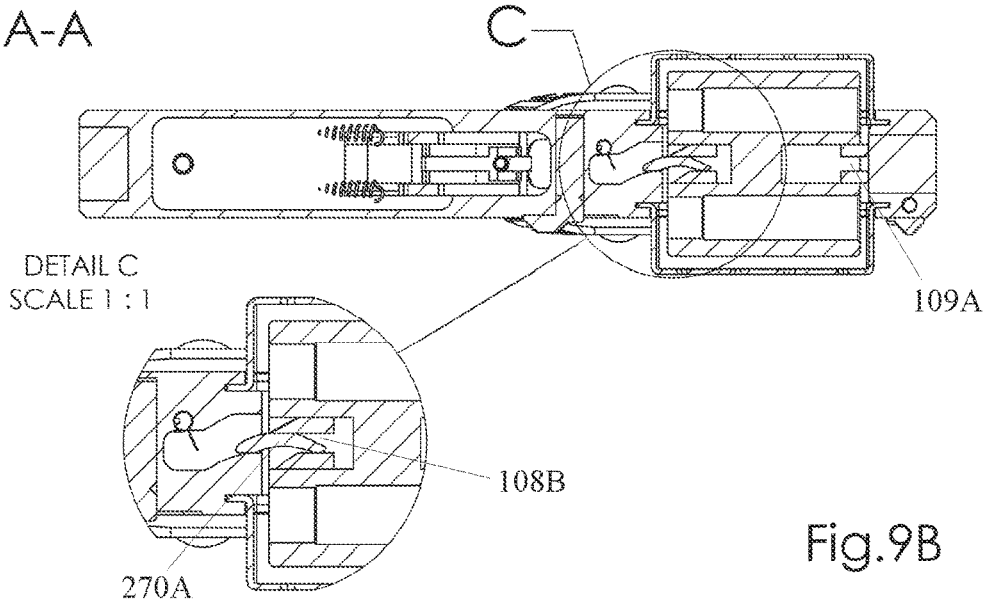

FIG. 9B shows a top-down cross-sectional views of the revolver's inside cut along the line A-A (cut shown relative to FIG. 9A). Specifically, FIG. 9B shows that guider head 270A in phase 5 may, under influence of the tension spring 386, move toward the front portion of the revolver 100. Abovementioned movement of guider head 270A does not initiate further rotational movement of drum 108.

Figure 9C:
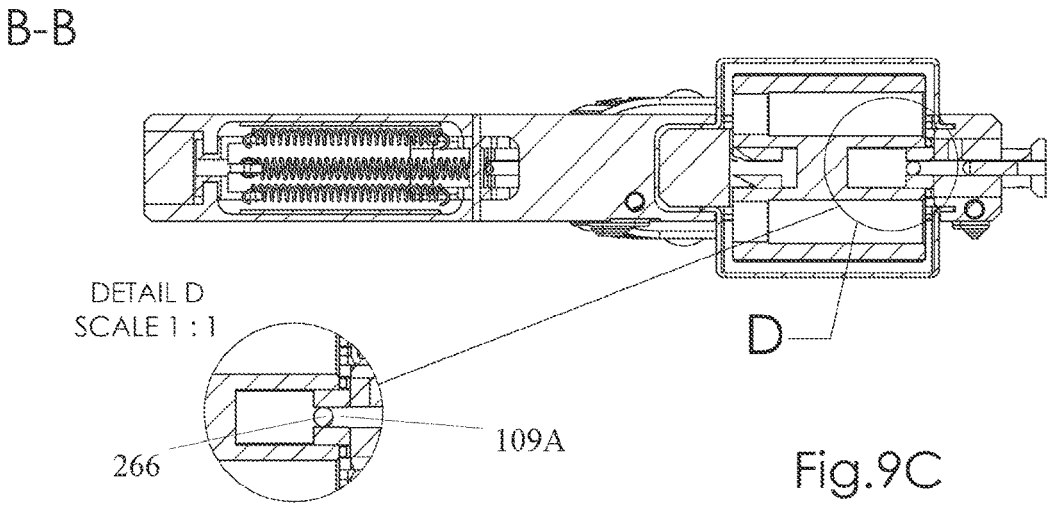

FIG. 9C shows a top-down cross-sectional views of the revolver's inside cut along the line B-B (cut shown relative to FIG. 7A). Specifically, FIG. 9C shows guiding pin 266 may start moving towards the front portion of the revolver 100 and may stay engaged with one of the plurality of drum slots 109A, keeping aligned the longitudinal axis of the upper most of plurality of spaced apart cartridge chambers 108A with the longitudinal axis of barrel 110.

Figure 10B:
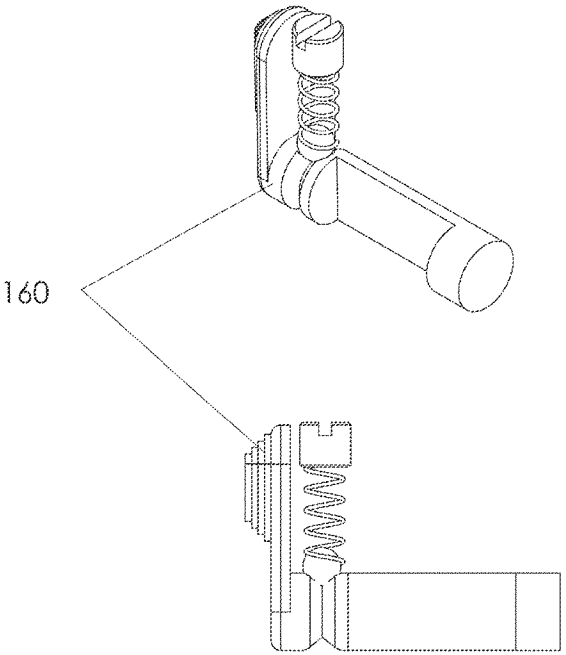
FIG. 10B shows both, a side and perspective view of the frame lock.
Figure 10A:
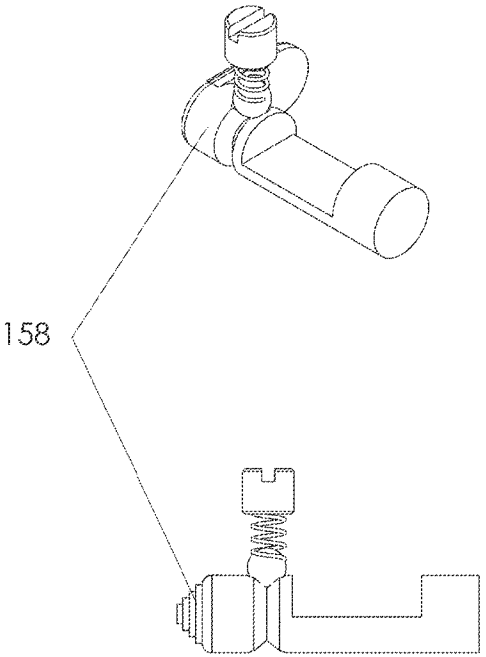
FIG. 10A shows both, a side and perspective view of the safety lock.

FIG. 10A exemplifies a perspective and side view of the safety lock 158 while FIG. 10B exemplifies a perspective and side view of the frame lock 160.

Figure 11B:
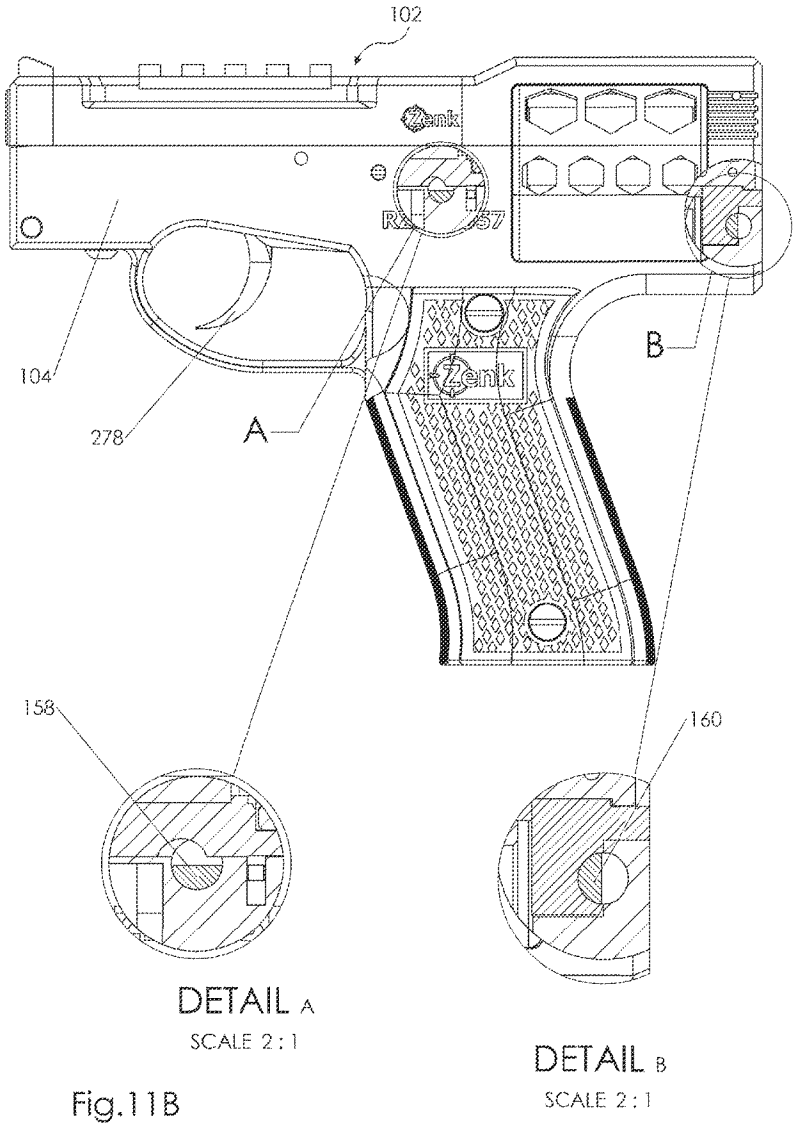
FIG. 11B shows side, partial cross-sectional views of both, an unlocked position of the safety and frame locks.
Figure 11A:
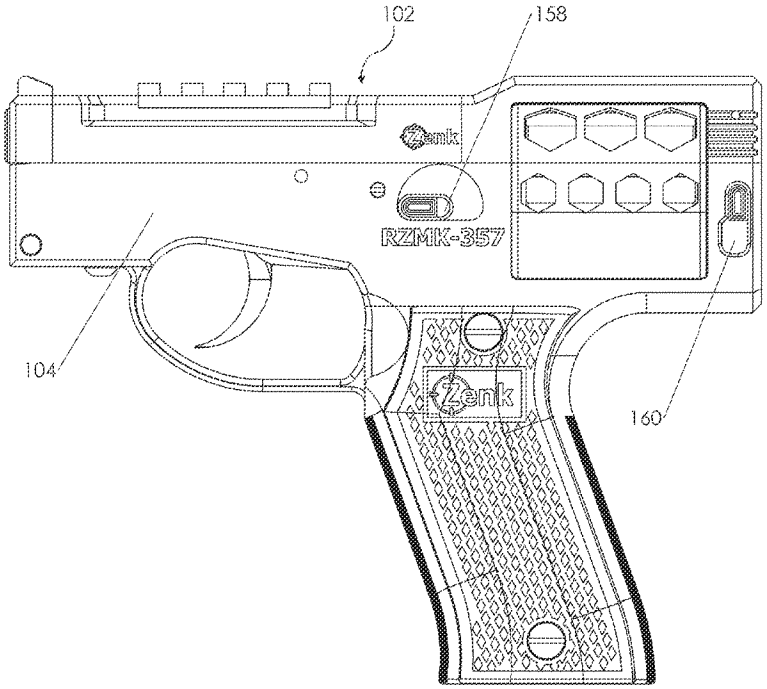
FIG. 11A shows a side view of both, an unlocked position of the safety and frame locks.

FIG. 11A exemplifies a side view of the revolver 100 where the safety lock 158 is in an unlocked position, ready to fire, while the frame lock 160 is in a locked position, such that the upper frame 102 and the lower frame 104 are locked together.

FIG. 11B exemplifies a cross sectional view of the safety lock 158 in an unlocked position while the frame lock 160 is in a locked position. Safety lock 158 does not prevent trigger 278 from operating, resulting in firing the cartridge, while the frame lock 160 prevents pivotal counter clockwise movement of the upper frame 102 in relation to the lower frame 104.

Figure 12B:
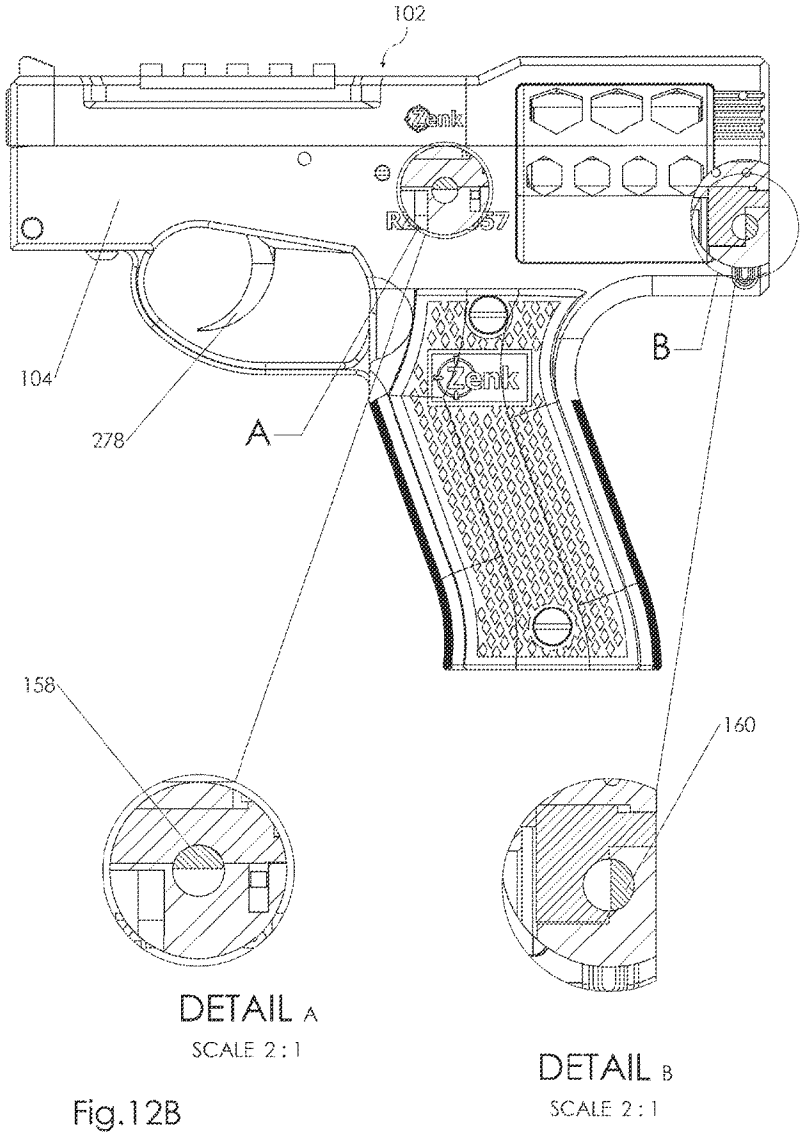
FIG. 12A shows a side view of both, a locked position of the safety and frame locks.
FIG. 12 B shows side, partial cross-sectional views of both, an unlocked position of the safety and frame locks.
Figure 12A:
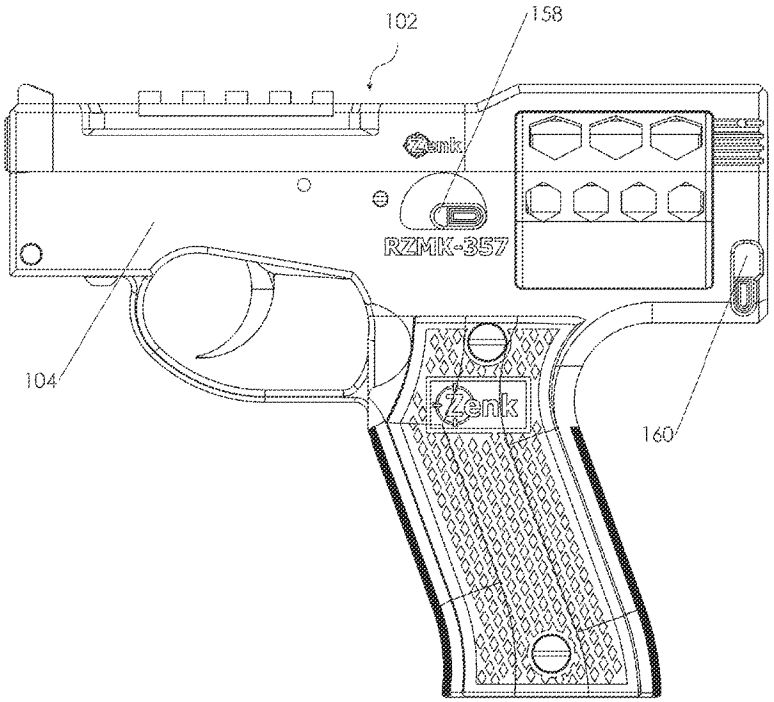

FIG. 12A exemplifies a side view of the revolver 100 where the safety lock 158 is in a locked position and the frame lock 160 is in an unlocked position.

FIG. 12B exemplifies a cross sectional view of the safety lock 158 in a locked position and the frame lock 160 in an unlocked position. Safety lock 158 prevents trigger 278 from operating, thereby preventing the inner firing assembly 101 from operating and firing the cartridge, while the frame lock 160 does not prevent pivotal counter clockwise movement of the upper frame 102 in relation to the lower frame 104.

Figure 13B:
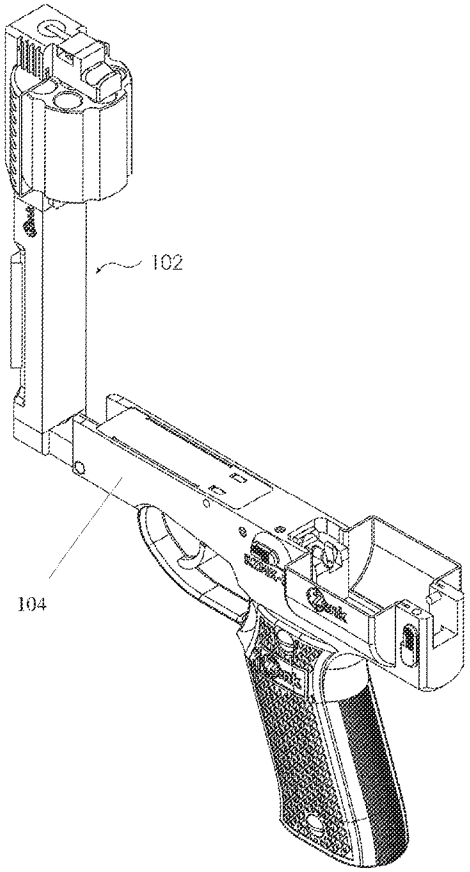
FIG. 13B shows a side cross-sectional view of the revolver, wherein the upper frame is in open position.
Figure 13A:
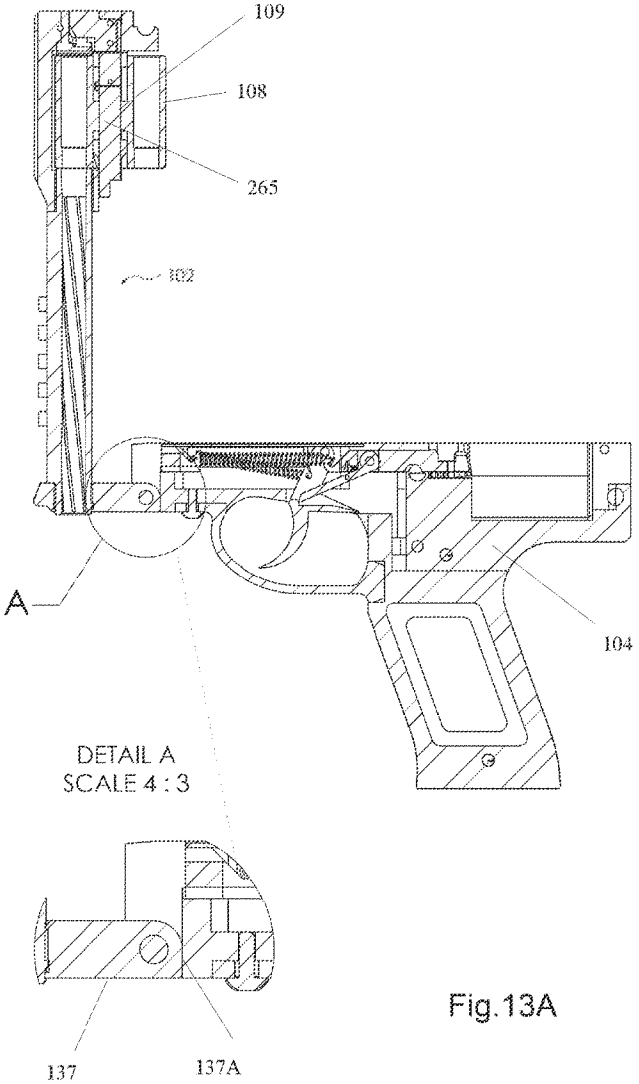
FIG. 13A shows a side cross-sectional view of the swivel arm.

FIG. 13A exemplifies a cross-sectional view of the revolver 100 in position where the upper frame 102 could be pivotally moved-up to 90°-relative to the lower frame 104. Swivel arm 137 may be in perpendicular position to the lower frame 104 and limiting surface 137A may not allow further pivotal movement of the upper frame 102. FIG. 13A also shows drum 108 positioned in the upper portion drum housing 107A, which is located in the upper frame 102, while drum 108 pivotally supported by hammer axle 265 which is inserted into slotted housing 109.

FIG. 13B exemplifies a perspective view of revolver 100, showing the upper frame 102 pivotally moved—up to 90°—relative to lower frame 104.

Figure 13C:
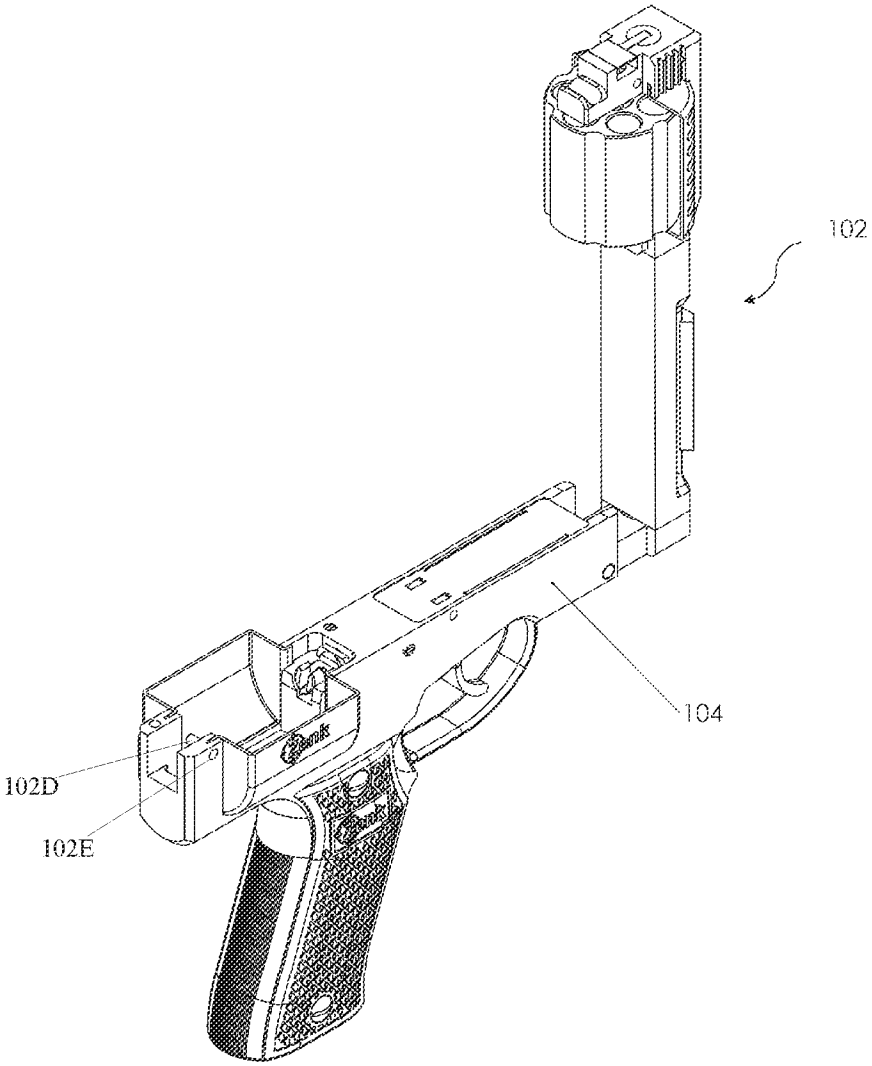
FIG. 13C shows a side cross-sectional view of the revolver, wherein the upper frame is in open position.

FIG. 13C exemplifies a perspective view of revolver 100 flipped in comparison to FIG. 13B showing guiding pin housing 102E and the limiting pin 102D located in upper frame 104.

Figure 13D:
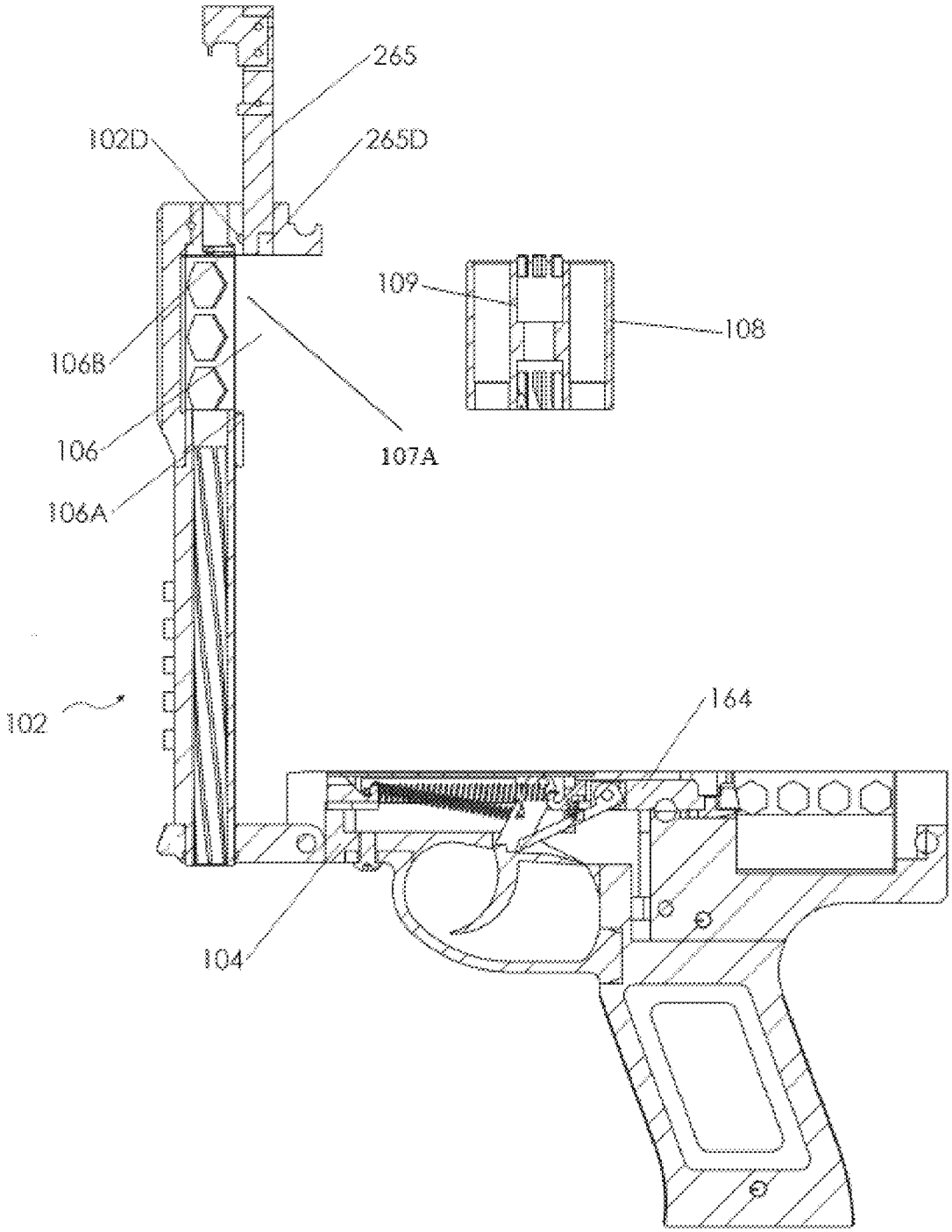
FIG. 13D shows a side cross-sectional view of the revolver, wherein the upper frame is in open position and the drum is released.

FIG. 13D exemplifies a cross-sectional view of the revolver 100, showing drum 108 detached from the hammer axle 265 and released from the drum housing 106 while the upper frame 102 is pivotally moved up-up to 90°-relative to the lower frame 104. Drum 108 may be removed from the upper drum housing 107A located in the upper frame 102 by sliding back the hammer axle 265 in such a position that the front portion of the male lock 265D is aligned with the upper back portion 106B of drum housing 106 (all the way out retracted from the upper frame 102) so the drum 108 could be released by pushing/releasing down from the upper frame 102. Drum 108 may be pivotally supported by hammer axle 265 and positioned into the upper drum housing 107A by the following steps:

a. aligning the longitudinal axis of the slotted housing 109 of drum 108 with the longitudinal axis of the hammer axle 265, while hammer axle 265 is all the way retracted from the upper frame 102 (as discussed above);

b. inserting the hammer axle 265 into slotted housing 109 while front portion of the male lock 265D passes the upper front portion 106A of the upper frame 102 (shown in FIGS. 13A-13C).

No matter what the pivotal position of the upper frame 102 is relative to the lower frame 104, the drum 108 will be pivotally supported by hammer axle 265 and horizontally supported by the upper front portion 106A and the upper back portion 106B of the upper portion of the drum housing 106.

Figure 14A:
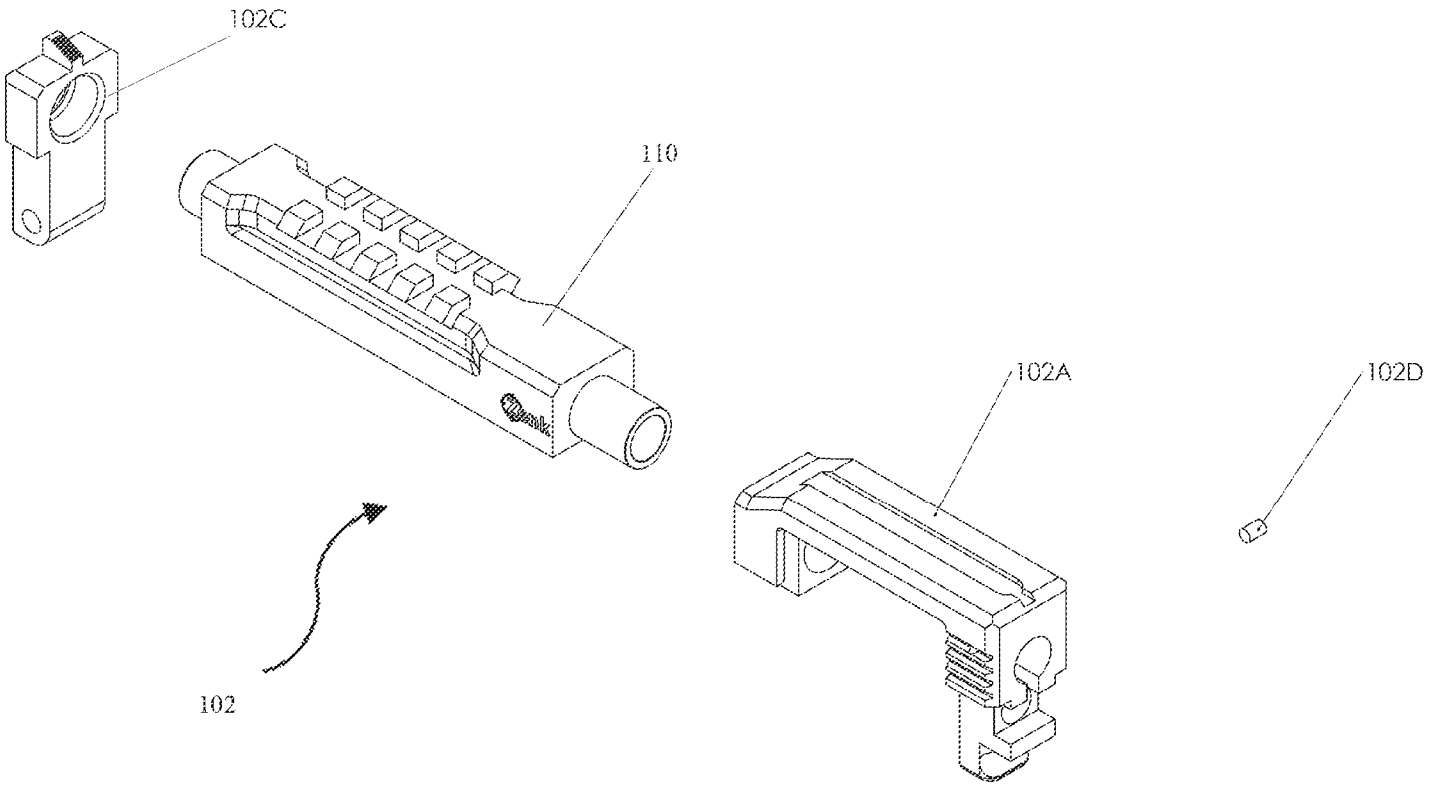
FIG. 14A shows an exploded view of the upper frame.

FIG. 14A exemplifies side perspective view of the upper frame 102 which may include muzzle 102C, barrel 110 and hammer axle housing 102A.

Figure 14B:
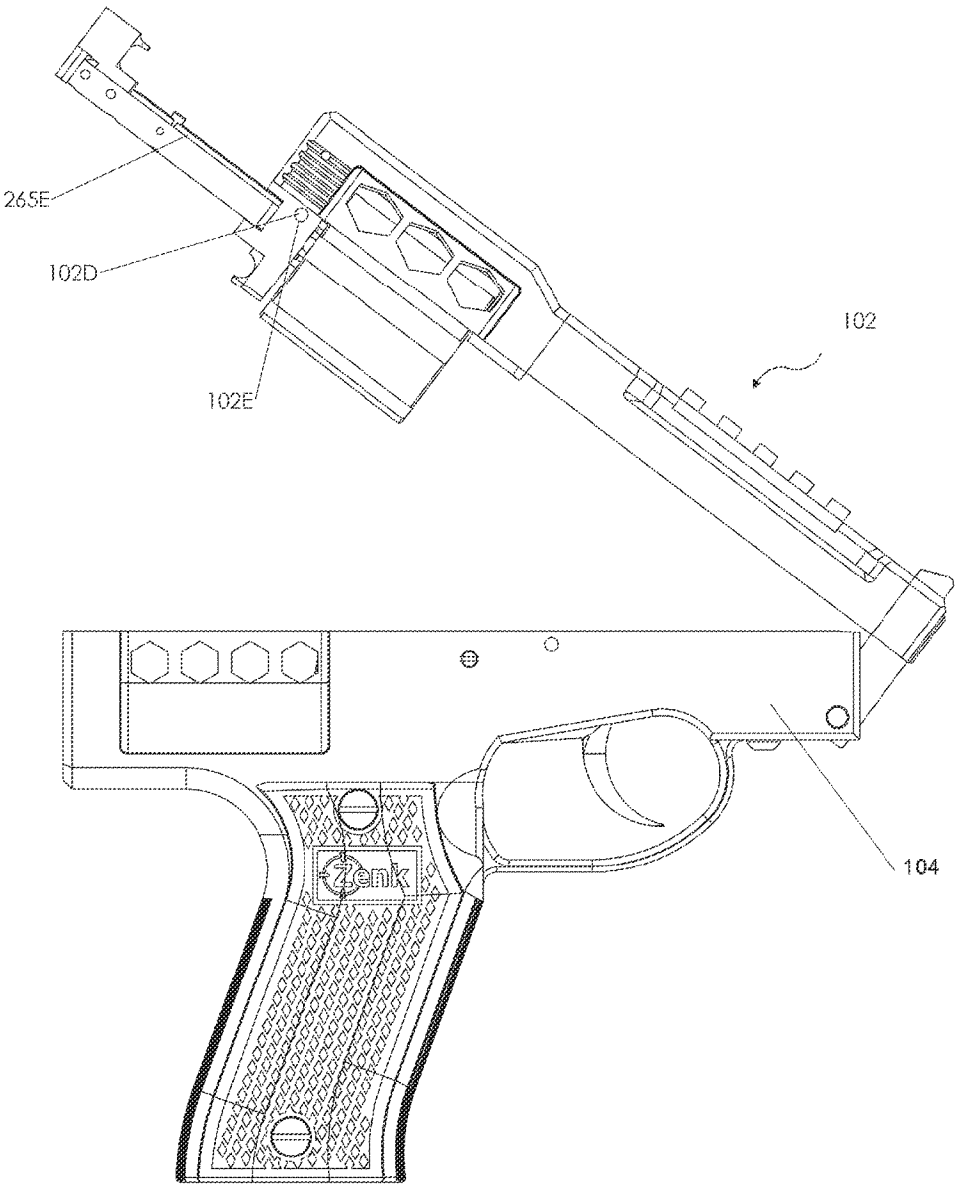
FIG. 14B shows a side view of the revolver, wherein the upper frame is opened and hammer axle is retracted.

FIG. 14B exemplifies a side view of the revolver, wherein the upper frame 102 is opened approximately 45° relative to the lower frame 104 and hammer axle 265 is retracted from the upper frame 102.

Figure 14C:
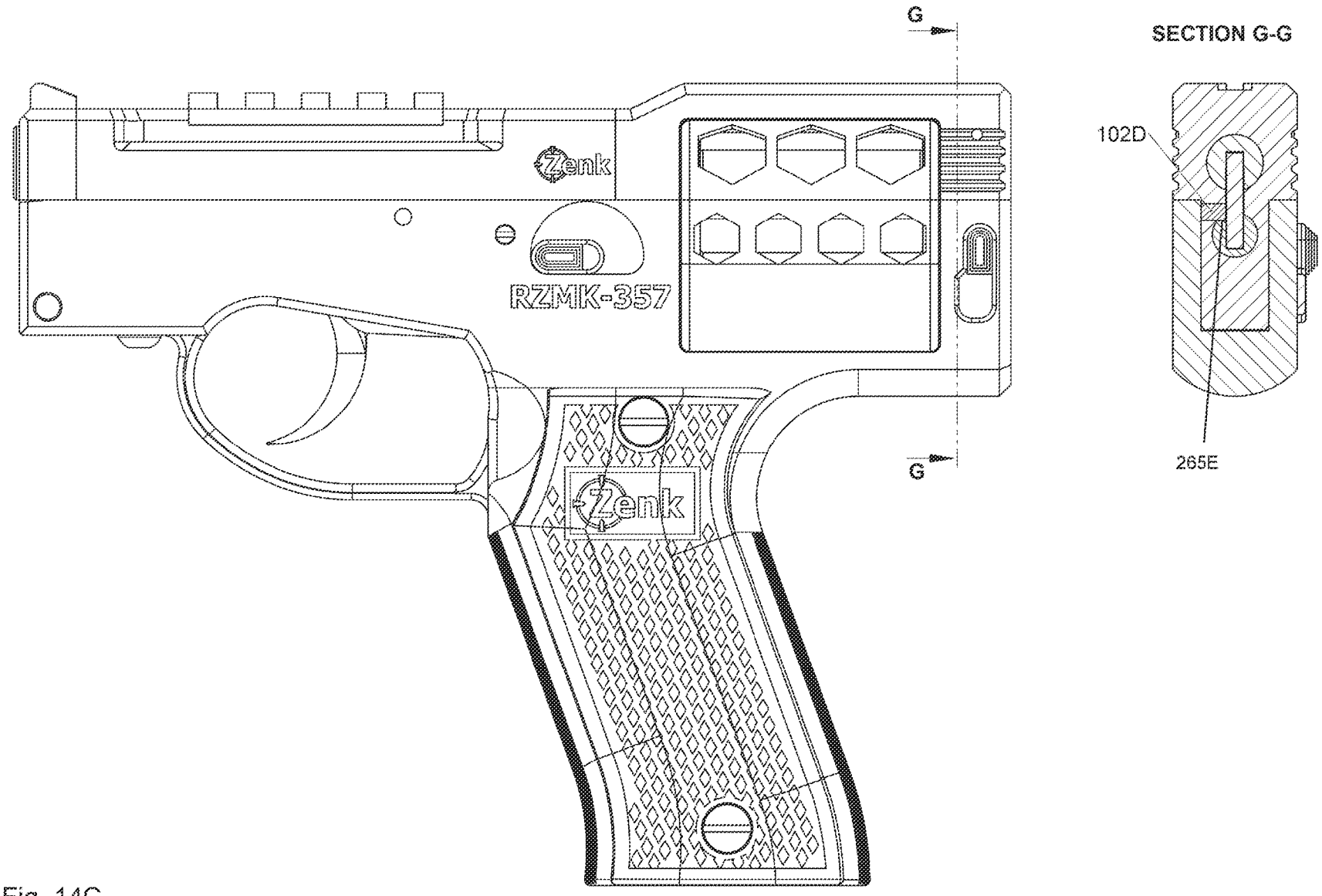
FIG. 14C shows a side and back cross-sectional views of the guider pin.

FIG. 14C shows side view and a rear-front cross-sectional views of the revolver's inside cut along the line G-G (cut shown relative to FIG. 14C).

Figure 15B:
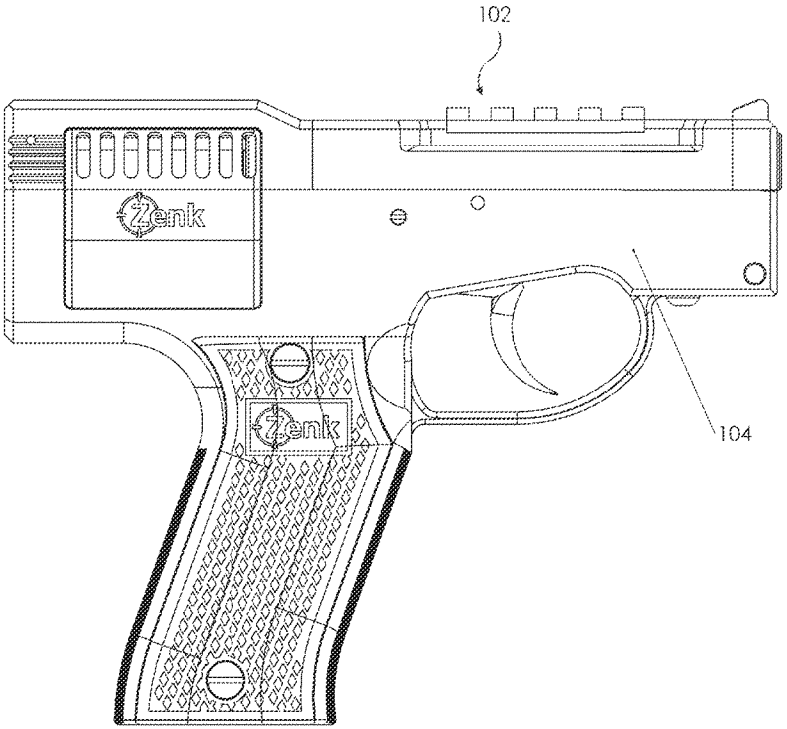
FIG. 15B shows a right side view of the revolver.
Figure 15A:
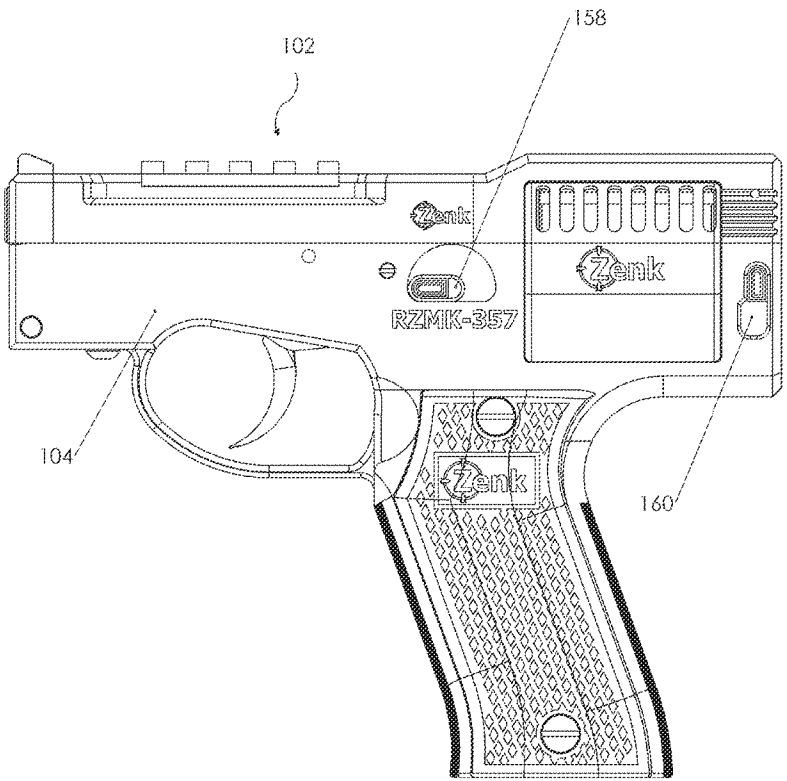
FIG. 15A shows a left side view of the revolver, wherein both, the safety and frame locks are unlocked.

FIG. 15A exemplifies a left side view of the revolver 100, wherein the upper frame 102 and the lower frame 104 are in a closed position. The safety lock 158 is in an unlocked position, so the revolver 100 is ready to fire, while the frame lock 160 is in the locked position so the upper frame 102 and the lower frame 104 are locked together.

FIG. 15B exemplifies a right side view of the revolver 100 wherein the upper frame 102 and the lower frame 104 are in a closed position.

Figure 15D:
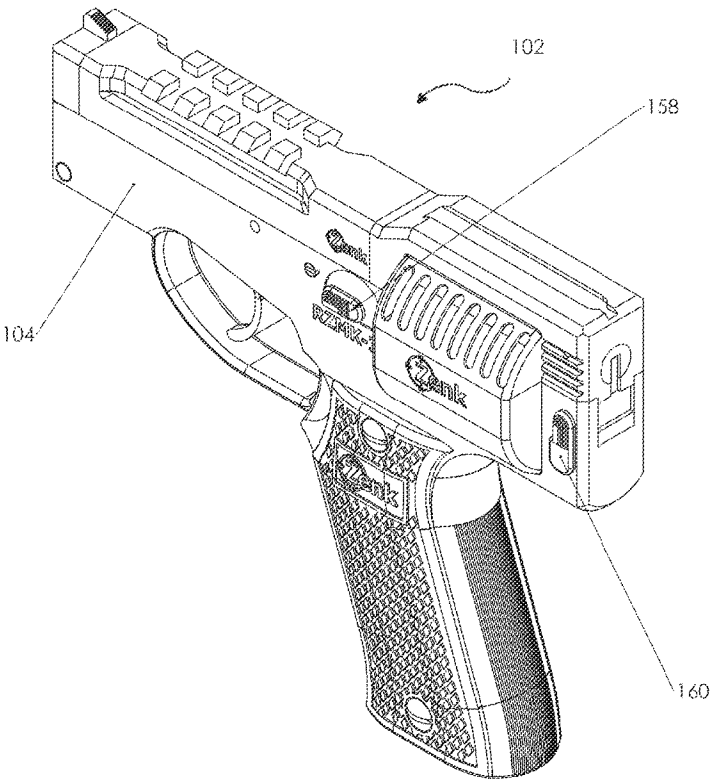
FIG. 15D shows a left perspective view of the revolver, wherein both, the safety and frame locks are in an unlocked position.
Figure 15C:
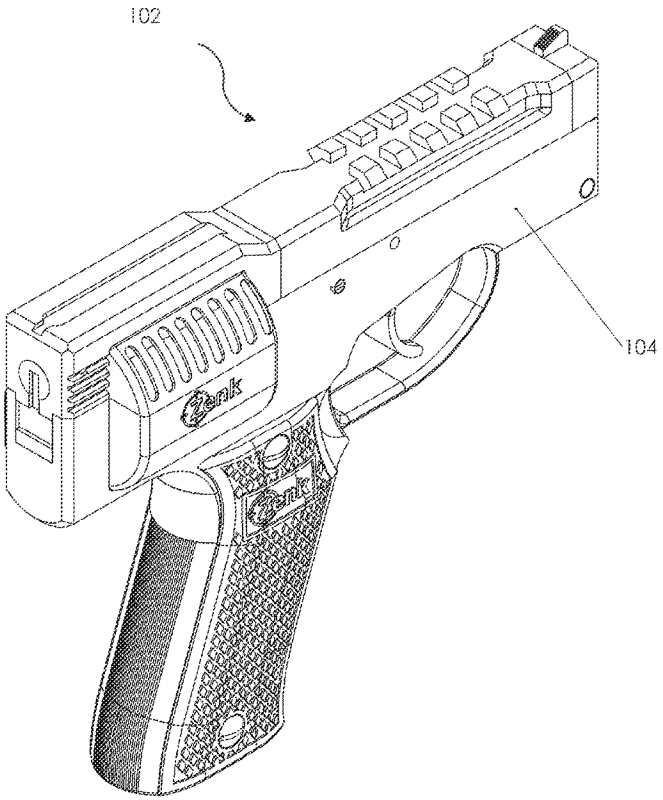
FIG. 15C shows a right perspective view of the revolver.

FIG. 15C exemplifies a right back perspective view of revolver 100 wherein the upper frame 102 and the lower frame 104 are in a closed position.

FIG. 15D exemplifies a left back perspective view of the revolver 100 wherein the upper frame 102 and the lower frame 104 are in a closed position, the frame lock 160 is in locked position while the safety lock 158 is in unlocked position.

Figure 15F:
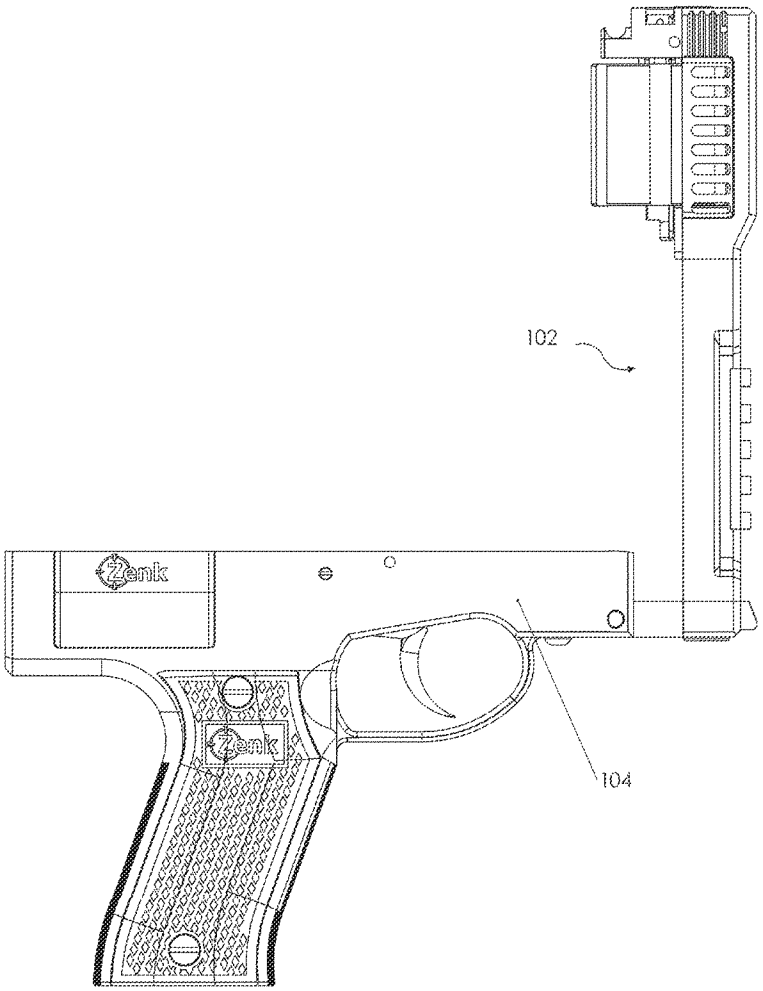
FIG. 15F shows a right-side view of the revolver, wherein the upper frame is in open position.
Figure 15E:
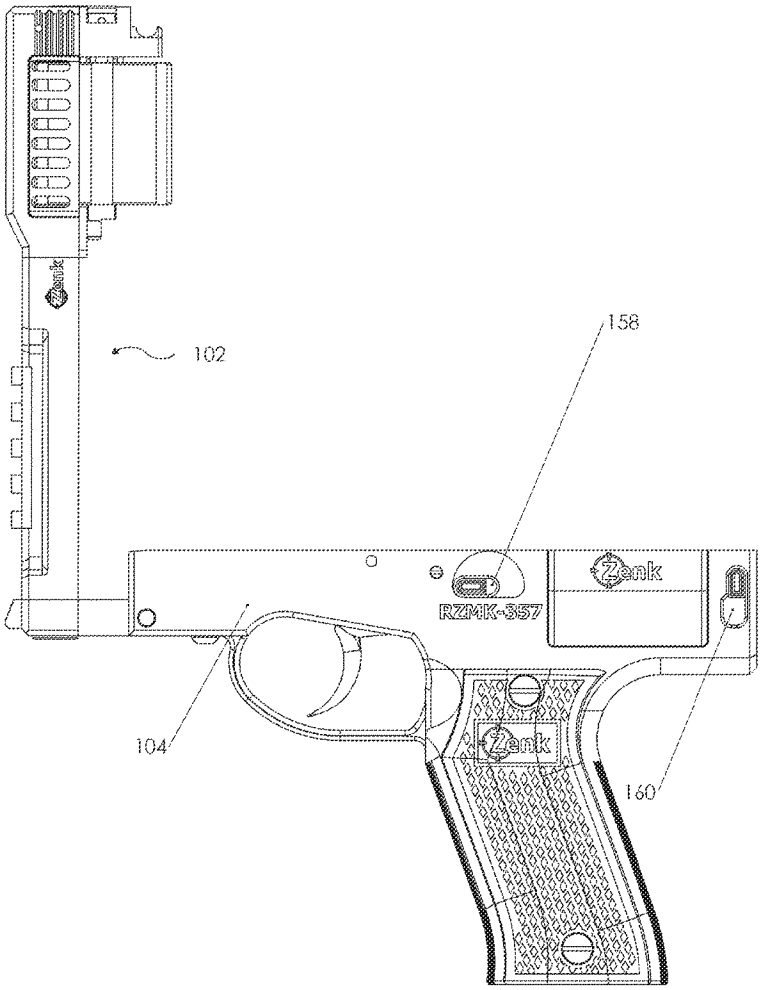
FIG. 15E shows a left side view of the revolver, wherein the upper frame is in open position.

FIG. 15E exemplifies a left side view of the revolver 100 with the upper frame 102 pivotally moved up.

FIG. 15F exemplifies a right side view of the revolver 100 with the upper frame 102 pivotally moved up.

Figure 15H:
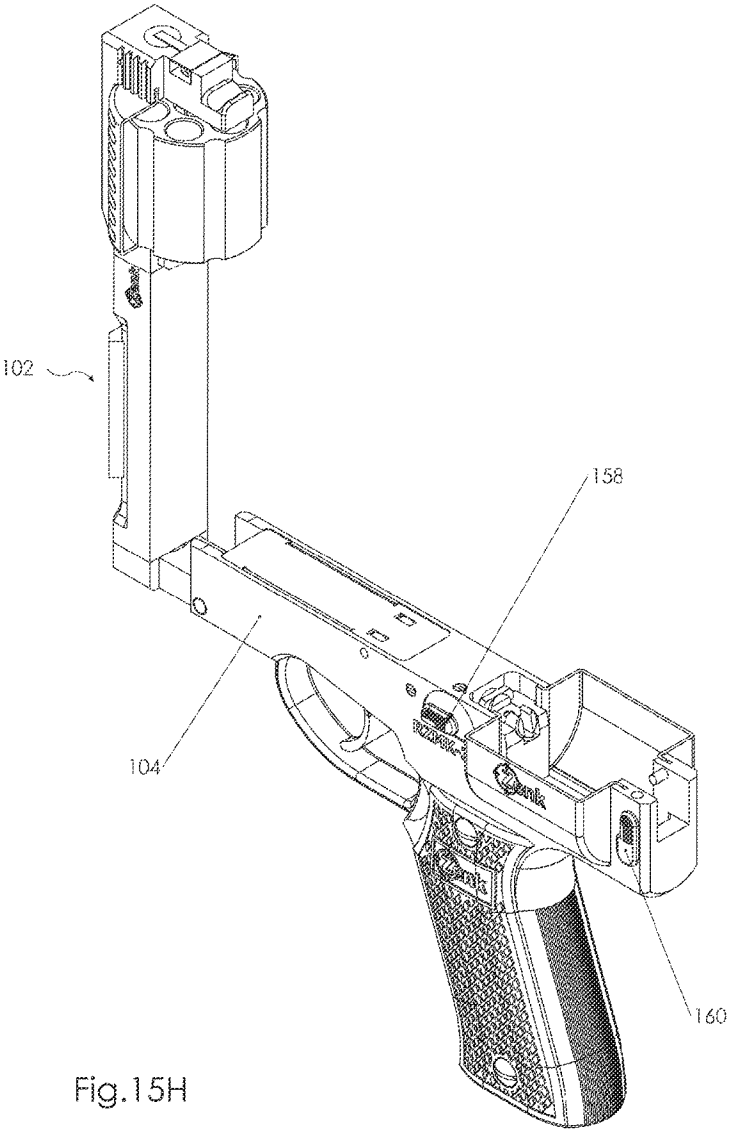
FIG. 15H shows a left perspective view of the revolver, wherein the upper frame is in open position.
Figure 15G:
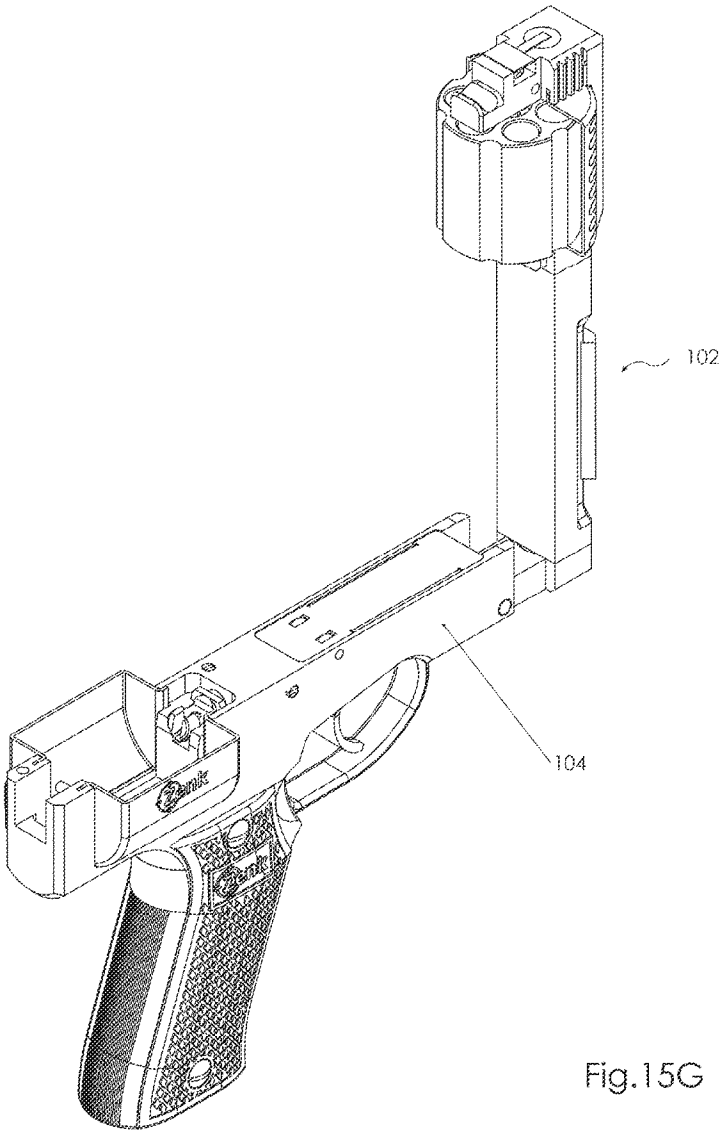
FIG. 15G shows a right perspective view of the revolver, wherein the upper frame is in open position.

FIG. 15G exemplifies a right back perspective view of the revolver 100 with a pivotally moved up upper frame 102.

FIG. 15H exemplifies a left back perspective view of the revolver 100 with a pivotally moved up upper frame 102.

What is claimed is:

1. An open frame revolver, comprising:

an upper frame and a lower frame pivotally connected together at a front of the open frame revolver, wherein the upper frame comprises of a muzzle, a barrel, and a hammer axle housing;

a handle removably connected to the lower frame;

a drum housing located in a rear end of the open frame revolver, wherein the drum housing comprises un upper drum housing located in the upper frame and a lower drum housing located in the lower frame;

a spring assembly located in a cavity of the lower frame;

a trigger mechanism located in the cavity of the lower frame, wherein the trigger mechanism through at least one trigger hook is connected to the spring assembly;

a tension axle located in the lower frame, wherein the tension axle on one end and through a tension axle hook is connected to the spring assembly, and on the other end, has a female lock;

a hammer axle supported by a housing of the upper frame, wherein the hammer axle has a male lock on one end and a hammer head attached to the other end of the hammer axle;

a firing tip located on the hammer head;

a drum positioned in the drum housing, wherein the drum is pivotally supported by the hammer axle, and the drum has a slotted housing at the radial center of the drum and a plurality of a spaced apart cartridge chambers;

a safety lock located in the lower frame; and a frame lock located on the lower frame.

2. The open frame revolver of claim 1, wherein a swivel arm extends downward from the muzzle and has a limiting surface.

3. The open frame revolver of claim 1, further comprising a firing tip guiding housing located in a back part of the upper frame wherein a firing tip guider is inserted into the firing tip guiding housing.

4. The open frame revolver of claim 1, wherein the spring assembly comprises of at least one spring bracket, at least one trigger spring, and at least one tension spring.

5. The open frame revolver of claim 1, wherein the trigger mechanism comprises of a trigger projecting downward from the lower frame, a sear positioned in between the trigger and the tension axle, and a compression spring located in between the trigger and the sear.

6. The open frame revolver of claim 5, wherein the trigger is pivotally connected to the lower frame.

7. The open frame revolver of claim 5, wherein the sear on one end is pivotally connected to the tension axle and on the other end is configured to engage with the trigger.

8. The open frame revolver of claim 5, wherein the trigger has an angular surface, a breaking line, and a hold notch.

9. The open frame revolver of claim 1, wherein a protrusion is located on the tension axle thereafter followed by the female lock.

10. The open frame revolver of claim 1, wherein a rotation foot is located at an underside of the tension axle.

11. The open frame revolver of claim 1, wherein a limiting pin channel is located on a side of the tension axle.

12. The open frame revolver of claim 1, wherein a guiding pin is protruding from a top surface of the hammer axle.

13. The open frame revolver of claim 12, wherein the guiding pin is configured to engage with one of a plurality of drum slots.

14. The open frame revolver of claim 1, wherein a rotation foot chamber is located in the lower frame.

15. The open frame revolver of claim 14, wherein a guiding spring is located in the rotation foot chamber.

16. The open frame revolver of claim 15, wherein the slotted housing contains a plurality of drum slots on one end of the drum and a plurality of rotational slots on another end of the drum.

17. The open frame revolver of claim 16, wherein the plurality of rotational slots are configured to engage with a front tip and flat surface of a guider head.

18. The open frame revolver of claim 17, wherein a rear tip of the guider head is configured to engage with a side wall of the rotation foot chamber.

19. The open frame revolver of claim 1, wherein a bracket housing is located in the cavity of the lower frame.

20. The open frame revolver of claim 1, wherein the female lock of the tension axle and the male lock of the hammer axle mate in such a way that the longitudinal axis of the tension axle and the longitudinal axis of the hammer axle align.

* * * * *